United States Patent [19]

Bader et al.

[11] Patent Number: 4,842,681

[45] Date of Patent: Jun. 27, 1989

[54] SPLICING METHOD AND APPARATUS FOR SHEET MATERIALS

[76] Inventors: B. Robert Bader, 6802 Bristol Way, Yakima, Wash. 98908; Bernard W. Bader, 1313 Browne Ave., Apt. 109, Yakima, Wash. 98902

[21] Appl. No.: 32,711

[22] Filed: Mar. 30, 1987

[51] Int. Cl.[4] ..... B65H 19/14; B65H 69/02

[52] U.S. Cl. ..... 156/504; 156/159; 156/497; 156/510; 242/56 R; 242/58.4

[58] Field of Search ..... 156/159, 504, 505, 497, 156/510; 242/58.1, 58.4, 58.5, 56 R

[56] References Cited

U.S. PATENT DOCUMENTS

| | | | |
|---|---|---|---|
| 2,724,426 | 11/1955 | Bell et al. | 156/504 |
| 2,752,984 | 7/1956 | Casey | 154/42 |
| 2,987,108 | 6/1961 | Kilmartin | 156/504 |
| 3,114,341 | 12/1963 | Diener | 156/504 |
| 3,586,583 | 6/1971 | Ospelt | 156/502 |
| 3,769,124 | 10/1973 | Johnson | 156/159 |
| 3,769,136 | 10/1973 | Ospelt | 156/308 |
| 3,820,446 | 6/1974 | Granbom et al. | 92/88 |
| 3,834,971 | 9/1974 | Johnson | 156/507 |
| 4,032,387 | 6/1977 | Sugiyama et al. | 156/580 |
| 4,157,934 | 6/1979 | Ryan et al. | 156/504 |
| 4,190,475 | 2/1980 | Marschke | 156/504 |
| 4,414,048 | 11/1983 | Kontz | 156/504 |
| 4,460,430 | 7/1984 | Kissell et al. | 156/504 |
| 4,481,053 | 11/1984 | Tokuno et al. | 156/504 |

*Primary Examiner*—Michael Wityshyn

*Attorney, Agent, or Firm*—Delbert J. Barnard

[57] ABSTRACT

A web of sheet material (10) from a first storage roll (16) is fed by feed rolls (12, 14) to a utilization station (18). A splicing machine (22, 22') is positioned between the storage roll (16) and the feed rolls (12, 14). A new roll (20) of sheet material (34) is positioned above storage roll (16). Shortly before the first storage roll (16) becomes empty, the leading end portion of the second web (34) is fed into the splicing machine (22, 22'), above a portion of the first web (10). Then, a loop forming roll (30) is moved downwardly, from an inactive upper position above the feed path of the web (10) to a lower position, to form a loop (L) in the web (10). Then, the web (10) is stopped rearwardly of the loop (L) and the splicing machine (22, 22') is operated to connect the new web (34) to the old web (10), while the feed rolls (12, 14) continue to operate to feed web (10) out from the loop (L). After the connection has been made, the feed rolls (12, 14) feed the joint, and then the new web (34), onto the utilization station (18).

35 Claims, 16 Drawing Sheets

68
70
72
82
80
76
86
84
78
79
54
90
66
74
44
22

72
66
68
74
86
84
78
79
44
70
82
80
76
22

30
158
160
158
30
44
24
66
60
68
79
56
58
62
42
64
88
70
76
22

12
11
44
46
48
50
52
54
56
58
60
62
64
66
68
74
76
88
90
26
28

Fig. 29
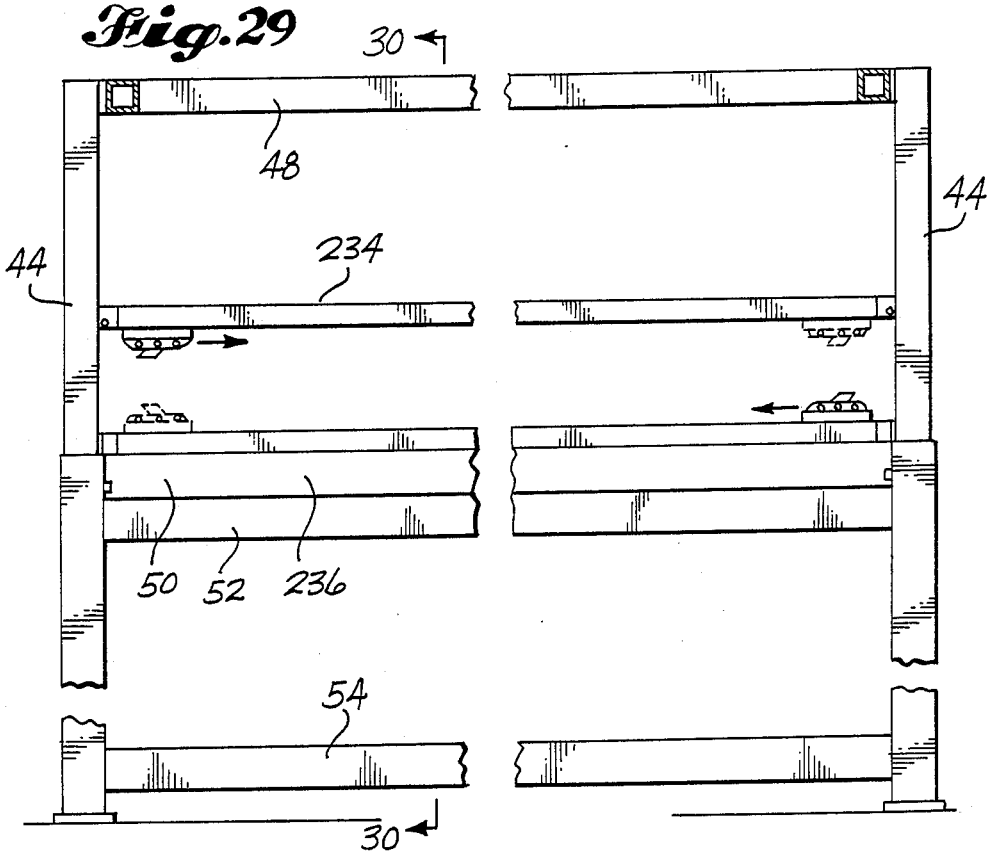
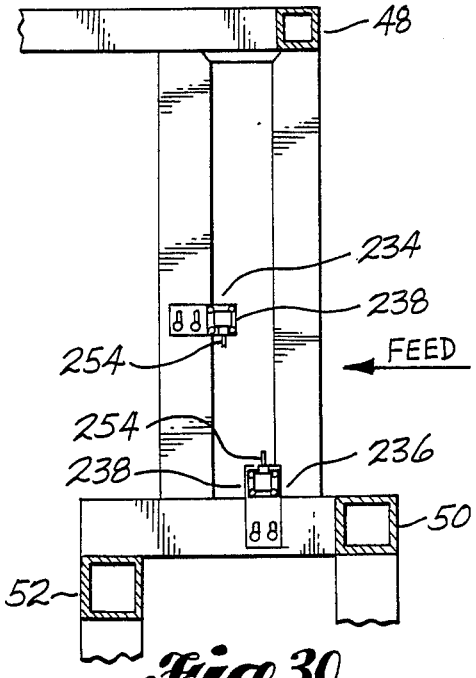
Fig. 30
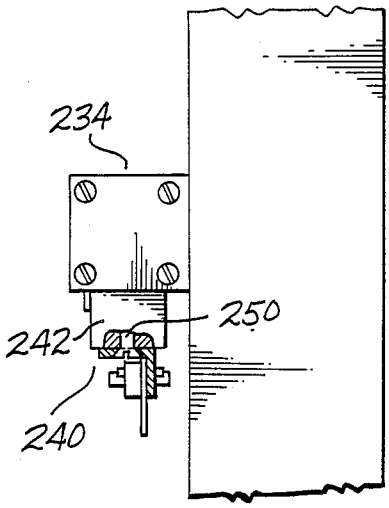
Fig. 31

Fig.32
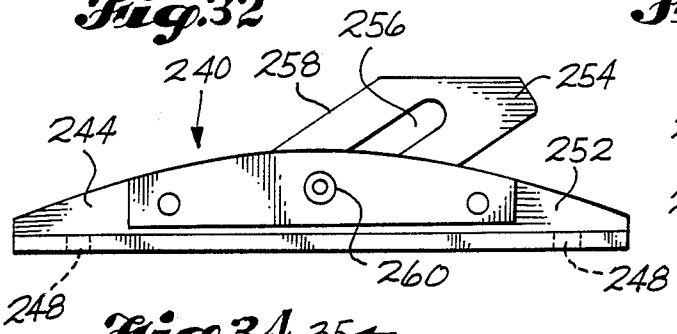
Fig.33
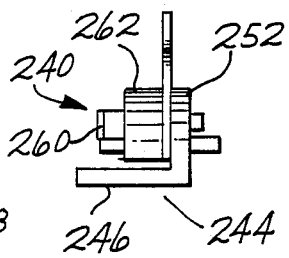
Fig.34
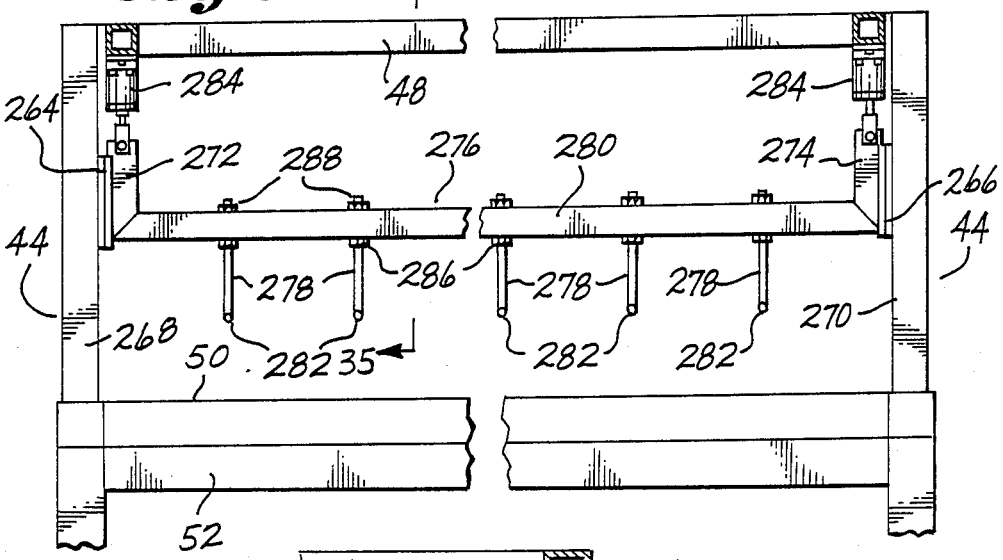
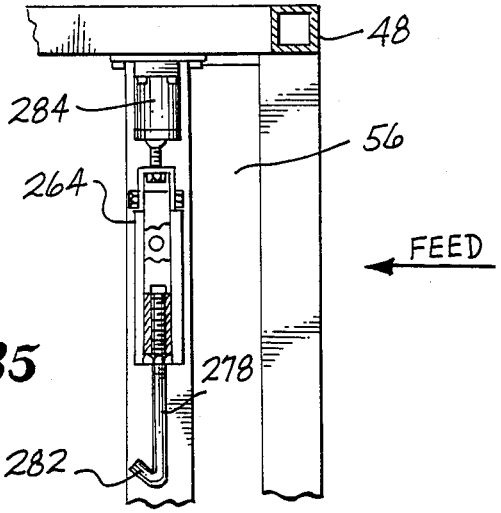
Fig.35

SPLICING METHOD AND APPARATUS FOR SHEET MATERIALS

DESCRIPTION

1. Technical Field

This invention relates to the feeding of sheet material from a storage roll to a machine for manufacturing the sheet material into a product. More particularly, it relates to a method and apparatus for connecting a leading end portion of a web of sheet material from a new or full roll to a trailing end portion of a web of sheet material from an almost empty roll, in a short interval of time and without any interruption in a continuous feed in the sheet material.

2. Background Art

There are many manufacturing processes in which a web of sheet material is fed from a storage roll to a machine which manufactures it into a product. When the roll of sheet material becomes empty or exhausted it is necessary to replace it with a new roll. It is known to attach a leading end portion of a web of sheet material from the new roll to a trailing end portion of the web of sheet material on the nearly empty roll, so that the web of sheet material on the new roll will be pulled into the manufacturing machine by the web of sheet material on the nearly empty roll.

Methods and apparatus existing in the patent literature for connecting sheet material from a new roll to sheet material from a nearly empty roll are disclosed by U.S. Pat. Nos. 1,547,129, granted July 21, 1925, to George Ritter; 2,752,984, granted July 3, 1956, to James H. Casey; 3,537,939, granted Nov. 3, 1970, to John H. Delaplaine and Joseph F. Scott; 3,769,124, granted Oct. 30, 1973, to David Emil Johnson; 3,834,971, granted Sept. 10, 1974 to David Emil Johnson; and 4,490,199, granted Dec. 25, 1984, to Frederick G. Dunning.

Other processes and apparatuses for connecting panels of sheet material and/or applying an adhesive or coating to sheet material, are disclosed by: U.S. Pat. Nos. 3,065,121, granted Nov. 20, 1962, to Alvadorem Andrews; 3,156,608, granted Nov. 10, 1964, to Jack M. Camins and Seymour R. Russell; 3,301,699, granted Jan. 31, 1967, to Henry J. Mozzi; 3,615,994, granted Oct. 26, 1971, to Ian A. MacLaine and Peter G. Montgomery; 3,586,583, granted June 22, 1971, to Edwin K. Ospeot; 3,586,584, granted June 22, 1971 to Chester Wilkins; 3,769,136, granted Oct. 30, 1973, to Edwin K. Ospelt; 4,240,855, granted Dec. 23, 1980, to William Pennington; and 4,289,559, granted Sept. 15, 1981 to Hiemer I. Hammer.

All of the above patents should be carefully considered for the purpose of putting the present invention into proper perspective relative to the prior art. Particular attention should be paid to Wilkins U.S. Pat. Nos. 3,586,584; Johnson 3,769,124; and Johnson 3,834,971. Each of these patents relates to edge-to-edge welding of thermal plastic foam sheets. Wilkins U.S. Pat. No. 3,586,584 discloses the use of moving work tables and clamps for supporting and moving the sheet material for formation of the butt weld joint. Johnson U.S. Pat. No. 3,769,124 supports and handles the sheet material during splicing by use of two pairs of clamping bars, one pair of which is movable relative to the other for the purpose of bringing the webs of sheet material together to form the butt joint. Wilkins U.S. Pat. No. 3,586,584; Johnson U.S. Pat. No. 3,769,124; and Johnson U.S. Pat. No. 3,834,971 all disclose using a heated wire for cutting the foam material and supplying the heat for welding the butt ends together.

DISCLOSURE OF THE INVENTION

In accordance with the present invention, a sheet material which is to be made into a product is fed from a storage roll to a processing station and storage rolls of the sheet material are changed while continuously feeding the sheet material. When a first roll of the sheet material is almost empty, a large loop is formed in the sheet material without stopping the feeding of the sheet material. Following formation of the loop, the sheet material behind the loop is stopped. Then, a leading end portion of sheet material from a second full roll is brought to the region of the sheet material rearwardly of the loop. The leading end portion of the sheet material from the new roll is connected to the stopped sheet material rearwardly of the loop while the sheet material from the first roll is being fed onto the processing station, as needed, out from the loop. Following the making of the connection, the feed of the sheet material from the first roll is continued. Such material will feed out from the loop until the loop no longer exists, at which time the sheet material from the first roll will pull the sheet material from the second roll on into the processing station behind it.

In preferred form, the loop is formed in the sheet material by moving a loop forming roll vertically against the sheet material while continuing to feed such sheet material. The movement of the loop forming roll acts to accelerate removal of sheet material from the first storage roll and forms a loop in such sheet material of a size sufficient to permit the sheet material to be fed from such loop while the sheet material from the second storage roll is being connected to it. This basic method does not depend on any particular way of making the connection.

In one embodiment of the invention a lap joint is formed and an adhesive is used to bond the overlapping portions together. In a second embodiment of the invention, the sheet material is cut where it is to be joined and a strip of tape is applied over the end portions of the sheet material to connect them together Other aspects of the invention are hereinafter described in the description of the best mode of the invention.

BRIEF DESCRIPTION OF THE DRAWING

Like reference numerals are used to designate like parts throughout the several views of the drawing, and:

FIG. 29 is an elevational view from the loop forming roll side of the machine, looking towards the upper and lower cutters;

FIG. 30 is an enlarged scale fragmentary sectional view taken substantially along line 30—30 of FIG. 29, showing the mounting arrangement and location of the cylinders which move the knives of the two cutters;

FIG. 31 is an enlarged scale end elevational view of an upper knife unit;

FIG. 32 is an enlarged scale side view of the knife unit;

FIG. 33 is an end view of the knife unit shown by FIG. 30;

FIG. 34 is a fragmentary elevational view of a hold down assembly;

FIG. 35 is a sectional view taken substantially along line 35—35 of FIG. 34;

BEST MODE FOR CARRYING OUT THE INVENTION

Figure 1:
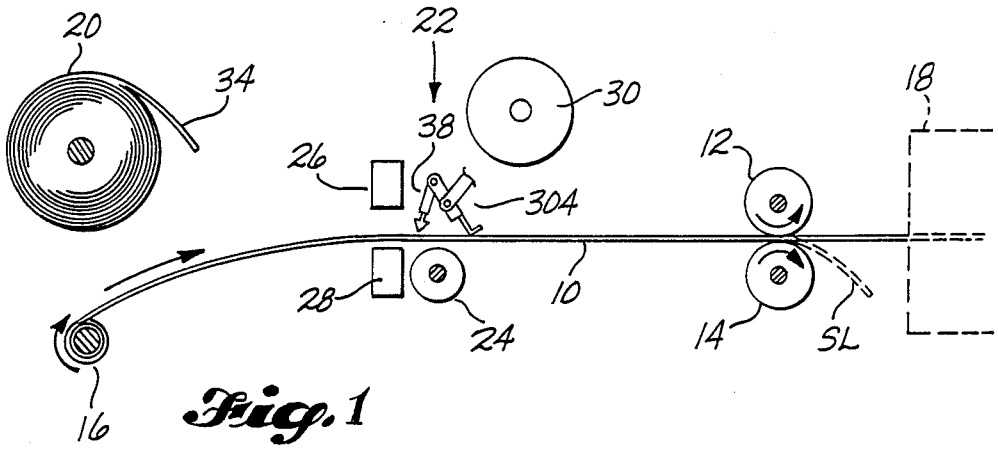
FIG. 1 is a schematic view of sheet material being fed by a pair of feed rolls from a first storage roll which is nearly empty, and further showing a full second storage roll of the sheet material spaced vertically from the first storage roll, and showing splicing equipment constructed according to the present invention, in an inactive condition, positioned between the storage rolls and the feed rolls.

Referring to FIGS. 1–6, a first web 10 of sheet material is shown in the process of being fed by a pair of feed rolls 12, 14 from a first storage roll 16 to a processing or utilization station 18. By way of typical and, therefore, nonlimitive example, the sheet material may be a thin foam plastic material and the processing station 18 may be a machine for making the sheet material into egg containers, hamburger containers, etc. In FIGS. 1–6 the web 10 is shown being fed along a straight feedline into the utilization station 18. In some prior art systems (e.g. Johnson U.S. Pat. No. 3,834,971) a loop exists between the feed rolls 12, 14 and the utilization station. The utilization station 18 may be a machine which operates intermittently. It pulls in a few feet of the web 10 at a time. The portion of the web within the machine is made into the product. Then, the product is removed from the machine and another few feet of the web 10 is brought into the machine.

In accordance with the present invention, a new or full second roll 20 of the sheet material is supported adjacent the first roll 16. The two rolls 16, 20 may be supported in any suitable manner, so that their axes are parallel to each other and to the axes of the feed rolls 12, 14. It is necessary that the rolls 16, 20 be capable of rotating to allow an off feeding of the web of sheet material, in response to a feeding force applied on the sheet material, by hand or by the feed rolls 12, 14. Preferably, the new roll 20 may be initially positioned vertically above the first roll 16. The rolls 16, 20 may be positioned on a turret as shown by the aforementioned Johnson U.S. Pat. No. 3,769,124, rotatable to move the new roll 20 into the position once occupied by the first roll. Or, the two rolls 16, 20 may be mounted at their ends for vertical travel in a way permitting removal of the first roll 16, after the joint has been formed, and a moving of the second roll 20 downwardly into the position previously occupied by the first roll 16. Then, a new third roll (not shown) can be positioned in the upper position. Or, the first roll 16 can be elevated above the position shown, so that the feed path of the web 10 off of roll 16 is substantially at the same level as the feed path of web 10 into the feed rolls 12, 14. And, the second roll 20 can be mounted at the same level but behind the first roll 16. The two rolls 16, 20 can be mounted so that following formation of the joint the first roll 16 can be removed and the second roll 20 can be shifted in position forwardly into the position once occupied by the first roll 16. Then, another new roll can be put into the position once occupied by roll 20.

In the illustrated embodiment, a splicing machine 22 is positioned between the location of the storage rolls 16, 20 (sheet storage station) and the location of the feed rolls 12, 14. A support or guide roll 24, or other suitable supporting and guiding means, is provided to help establish a feed path of the sheet material. In preferred form, the feed path extends between a pair of splicer heads 26, 28. As will hereinafter be described in greater detail, the splicer heads 26, 28 are movable together and apart.

Figure 2:
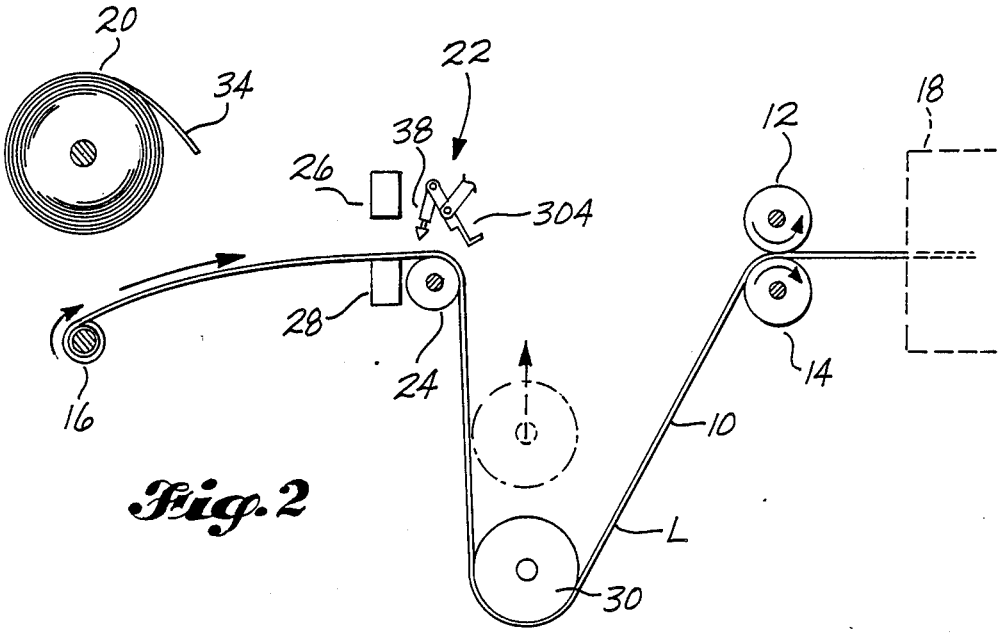
FIG. 2 is a view like FIG. 1, but showing a loop forming roll moved downwardly to form a large loop in the sheet material, while the sheet material is being fed to the processing station, such view also including a broken line showing of the loop forming roll in the process of moving back up into an inactive position above the feed path of the sheet material.

The splicing machine 22 includes a loop forming roll 30 which is movable vertically between an elevated or upper inactive position (FIG. 1) and a substantially lower loop forming position (FIG. 2).

FIG. 1 shows the web 10 of sheet material being fed by the feed rolls 12, 14 off from the first storage roll 16. It also shows the first storage roll 16 in an almost empty condition. Shortly before the first storage roll 16 is completely empty, the loop forming roll 30 is moved downwardly, from the upper position shown by FIG. 1 to the lower position shown by FIG. 2. This is done while the feed rolls 12, 14 continue operating to feed the first web 10 onto the processing station 18. The loop forming roll 30 is free to rotate about its axis. Roll 28 rotates in response to the movement of the web 10, as it is being moved downwardly to form the loop L.

The loop roll 30 is promptly retracted following formation of the loop L. Then, the portion of the web 10 which is within the splicing machine 22 is stopped. However, the feed of the web 10 to the processing station 18 is not stopped. The feed rolls 12, 14 continue to operate except now they feed sheet material from the loop L rather than off from the first storage roll 16. The stopped portion of the web 10 is cut to form a squared rear end 32, by a cutting mechanism that is hereinafter described. The web 34 of sheet material from the second storage roll 20 is moved into the splicing machine 22. A second cutter is operated to cut it to form a square cut front end 36. The second cutter will also be hereinafter described.

The splicer heads 26, 28 include suction devices for grabbing and holding the webs 10, 34. These suction devices and other features of the splicer heads 26, 28 are hereinafter described.

The suction device that is a part of the upper splicer head 26 is used for holding the leading end portion of the web 34 against the splicer head 26. In similar fashion, the suction device that is a part of the lower splicer head 28 is used for holding the rear end portion of the web 10 against the lower splicer head 28. The spliting machine 22 includes means for delivering adhesive onto the held end portion of one of the webs 10, 34. Preferably, the adhesive is applied by a spray bar mechanism which includes a plurality of spray nozzles 38, positioned to discharge the adhesive onto the upper surface of the rear end portion of web 10. The spray bar mechanism, and an adhesive delivery system associated with it, will be hereinafter described in detail.

Figure 3:
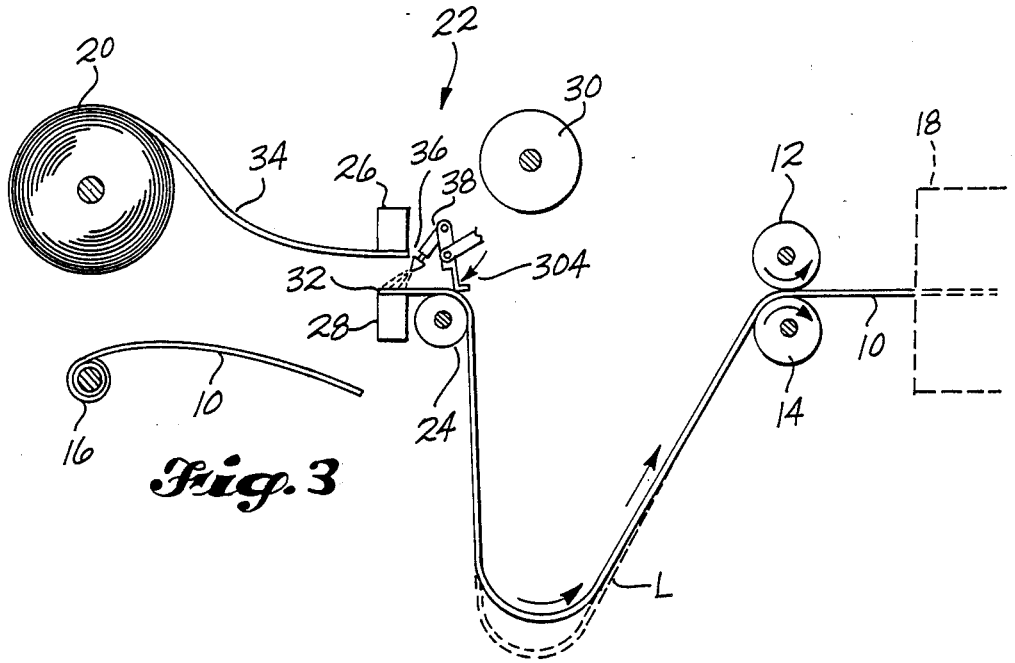
FIG. 3 is a view like FIGS. 1 and 2, showing the loop forming roll elevated back up into its inactive position above the feed path of the sheet material, and showing a rear end portion of sheet material on the first storage roll severed from the sheet material forwardly of it in which the loop has been formed, and showing sheet material being fed from said loop, and showing an adhesive being applied to an upper rear end portion of the sheet material.

As shown by FIG. 3, in the illustrated example, the adhesive is sprayed onto the upper rear end portion of the web 10 while the two end portions of the webs 10, 34 are held apart. Then, adhesive delivery is stopped and the splicer heads 26, 28 are moved together. Splicer heads 26, 28 press together the lapped end portions of the webs 10, 34, with the adhesive in between. This pressure causes the adhesive to bond the end portions of the webs 10, 34 together. While this is happening, the feed rolls 12, 14 continue to feed web 10 from the loop L onto the processing station 18.

Figure 5:
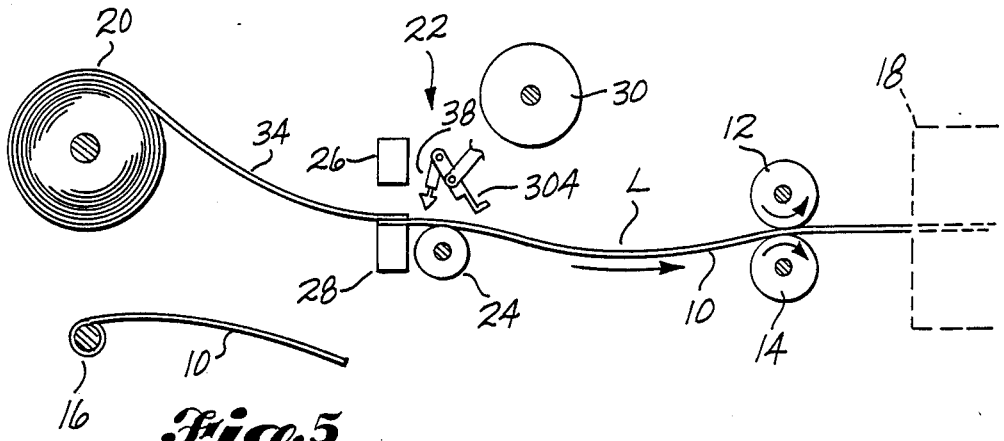
FIG. 5 is a view like FIGS. 1-4, showing the two splicer heads retracted away from the joint, and showing the sheet material still in the process of being fed out from the loop.
Figure 6:
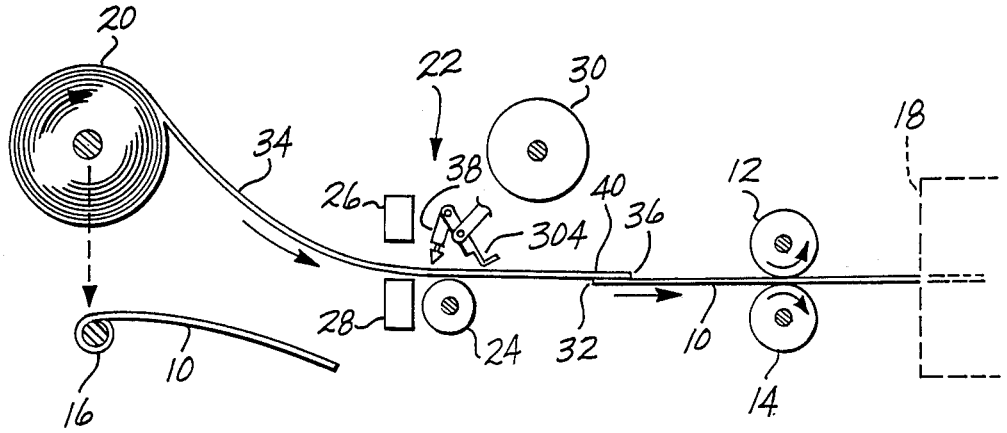
FIG. 6 is a view like FIGS. 1-5, showing tension in the joint and showing the feed rolls starting to pull sheet material out from the second storage roll.

The splicer heads 26, 28 are held together for a short interval of time, then they are moved apart.(FIG. 5). The feed rolls 12, 14 then continue feeding the web 10 from the loop L. Eventually, the loop L will disappear. When this happens, the pull of the feed rolls 12, 14 will be exerted on the joint 40 and on the web 34 behind the joint 40. The feed rolls 12, 14 will feed the joint 40 to and through the processing station. Joint 40 will appear in some of the articles being manufactured in the processing station 18, probably making it necessary to disregard such articles. However, the presence of the joint 40 will not interfere with the operation of the processing station 18.

Following passage of joint 40 through the feed rolls 12, 14, the feed rolls 12, 14 will function to pull the web 34 off of the second storage roll 20 and feed it onto the processing station 18. The expired first storage roll 16 can be replaced with another new roll (not shown) which will include a web that will be eventually connected to the web 34, when the second storage roll 20 reaches a near empty condition.

A preferred embodiment of the splicer machine of the invention, and other steps of the method of the invention, will now be described, with reference to FIGS. 7–42.

For clarity of illustration, the various functional parts of the splicer machine 22 have been separately illustrated. A portion of the machine frame 42 has been included in most of the views, to serve together with the sequence of operation diagrams (FIGS. 1–6) to show how each part is physically positioned and related to the other parts.

Figure 7:
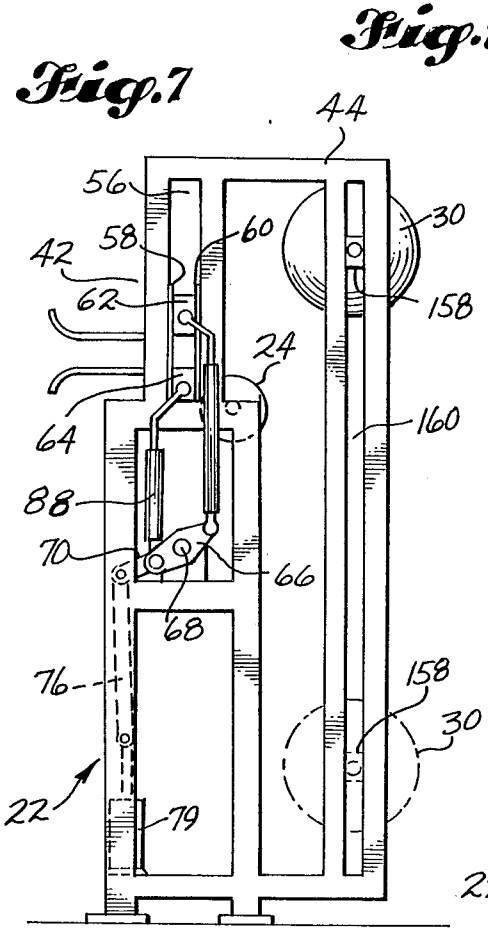
FIG. 7 is an end elevational view of an embodiment of a frame provided for supporting the joint forming components, showing a mechanism for moving the splicer heads together and apart, and further showing a guideway for an end portion of a center support for the loop forming roll.

Referring first to FIG. 7, this view is an end elevational view of the machine 22. It shows a typical end configuration of the frame 42. The two ends 44, 46 are alike so only one is illustrated. Frame 42 includes horizontal members 48, 50, 52, 54 which extend between and interconnect the two end portions 44, 46. Some of these horizontal members are shown in FIGS. 11, 21, 27, 29, 30, 34, 36, and 41.

Figure 42:
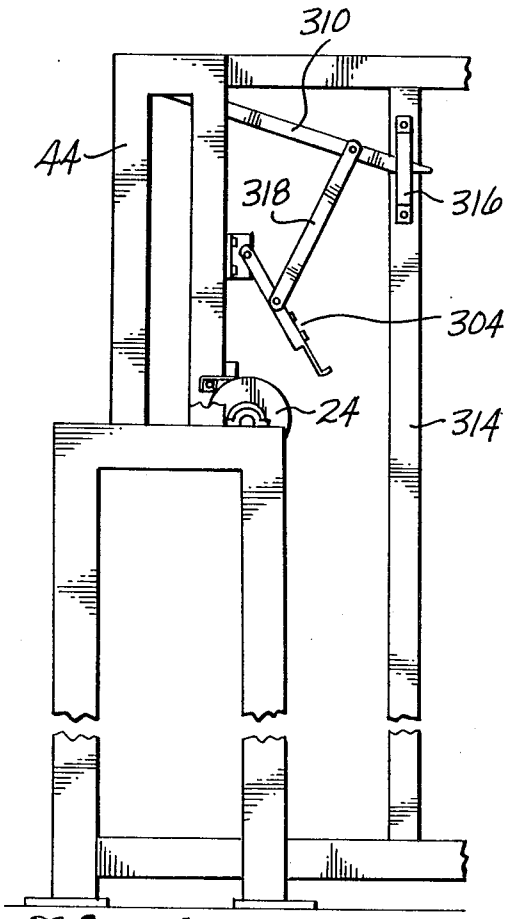
FIG. 42 is an end elevational view of the stop gate.
Figure 41:
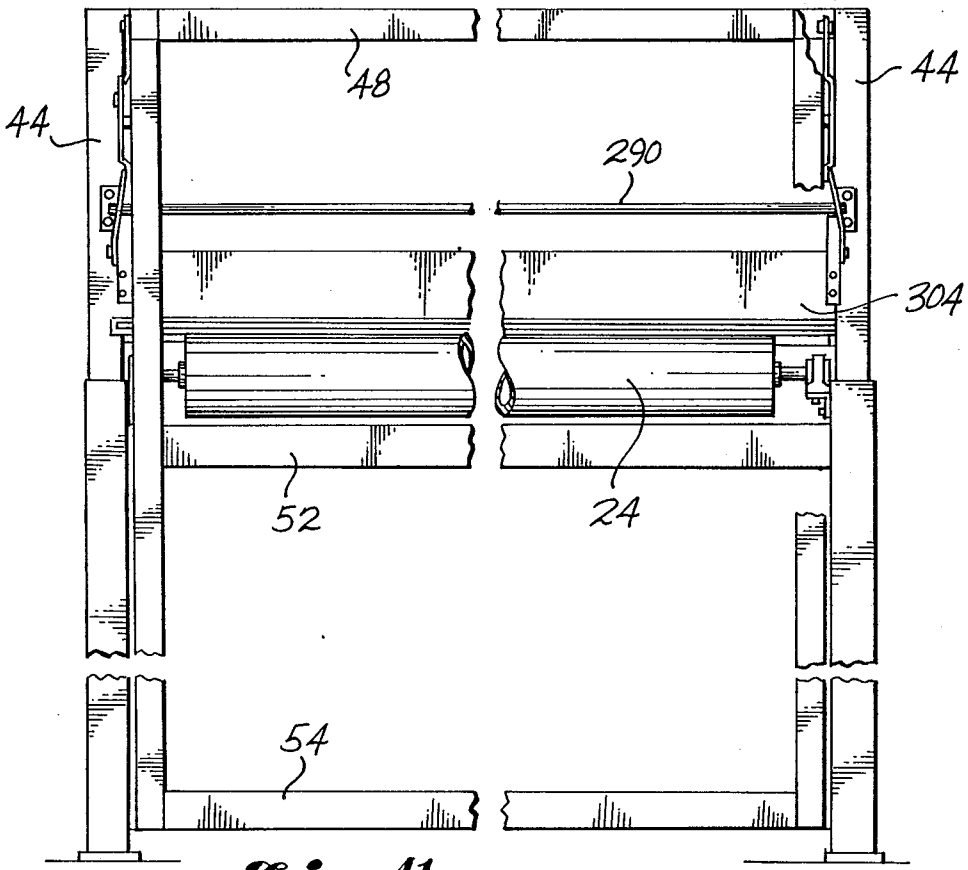
FIG. 41 is an elevational view taken from the loop forming roll side of the machine, presenting an elevational view of a stop gate.

Referring again to FIG. 7, the support roll 24 is shown positioned adjacent the lower splicer head 28. Support roll 24 is also shown in FIGS. 41 and 42.

A vertical guideway 56 is formed in each end portion 44, 46 of the frame 42. Each guideway 56 is lined by bearing strips 58, 60 of a self-lubricating plastic material or equivalent material. End portions 62, 64 of the upper and lower splicer heads 26, 28 are located in the guideways 48, between the bearing strips 50, 52. This is best shown by FIGS. 10 and 12.

Figure 9:
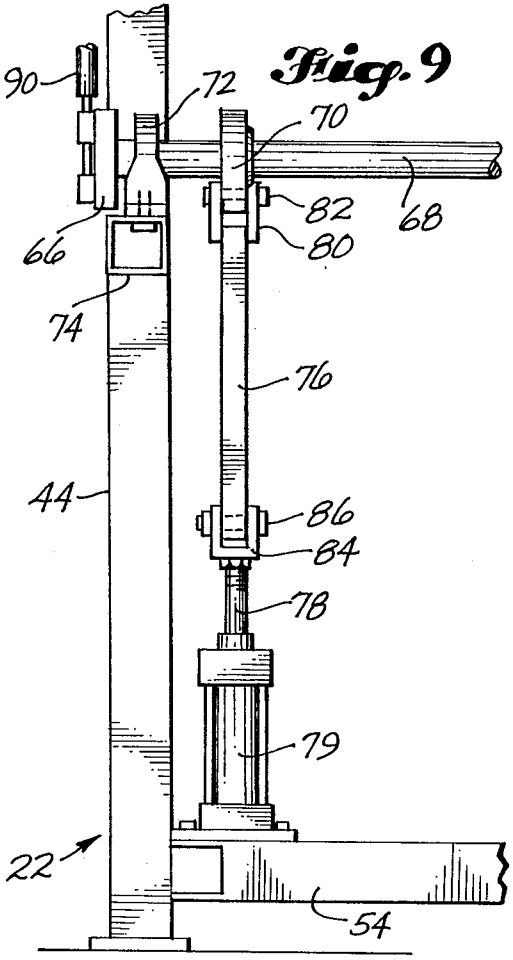
FIG. 9 is a sectional view taken substantially along line 9—9 of FIG. 8.
Figure 8:
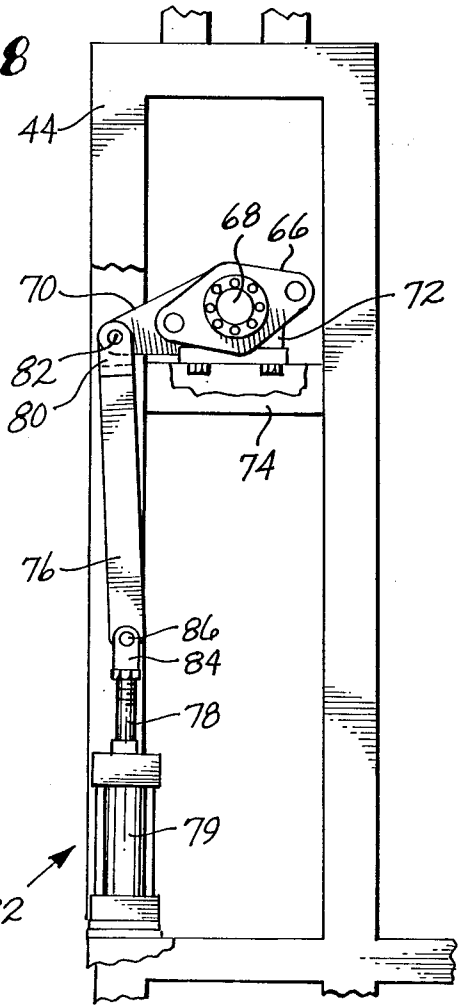
FIG. 8 is an enlarged scale fragmentary view of the lower portion of the mechanism which moves the splicer heads together and apart.
Figures 10, 11, 12:
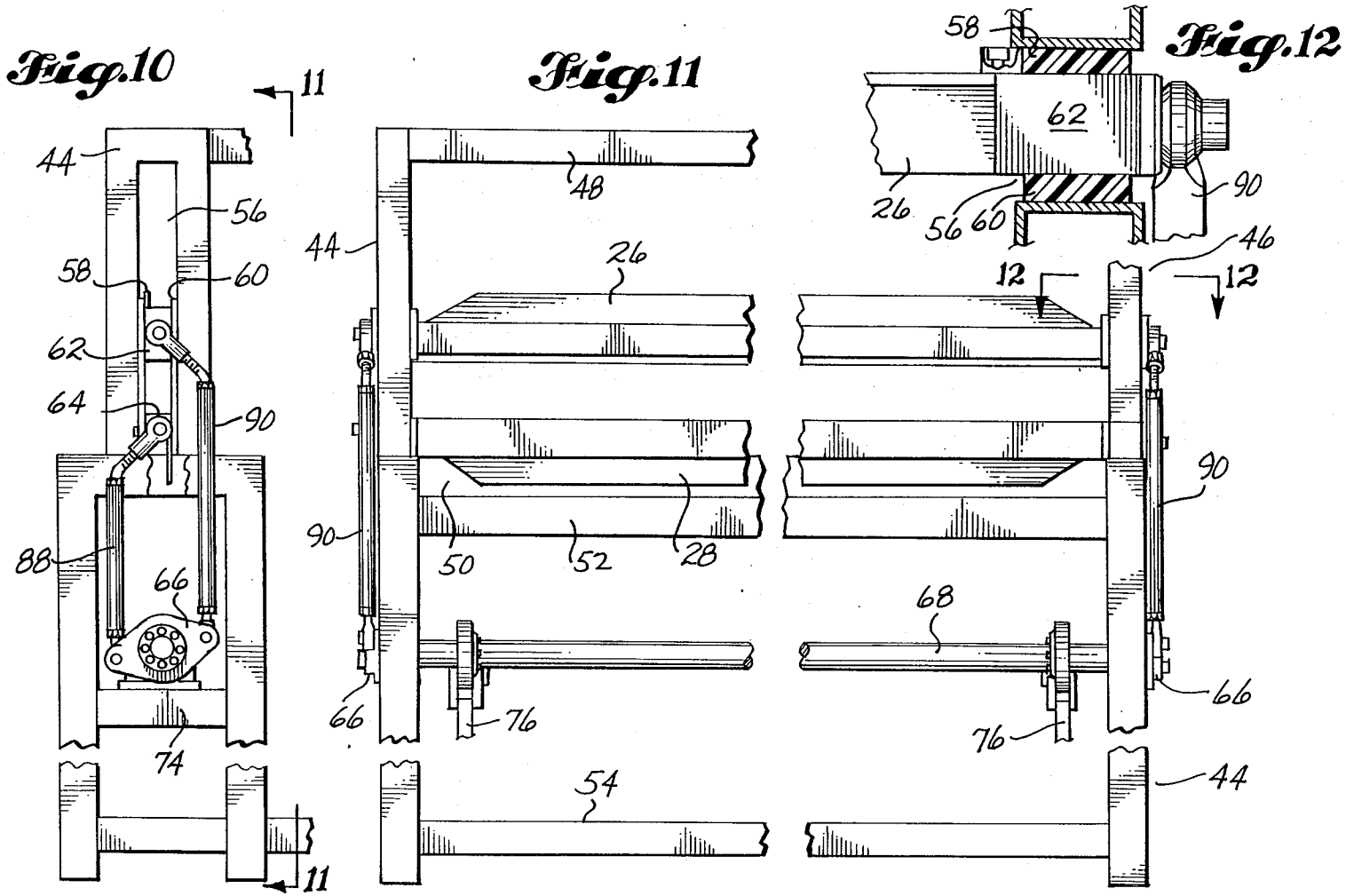
FIG. 10 is a larger scale (than FIG. 7) fragmentary view of the upper portion of the mechanism which moves the splicer heads together and apart.
FIG. 11 is a vertical sectional view taken substantially along line 11—11 of FIG. 10.
FIG. 12 is an enlarge scale fragmentary sectional view taken substantially along line 12—12 of FIG. 11 showing one end of the upper splicer head and portions of a slideway which mounts it for up and down movement.

Referring to FIGS. 7 and 10, a teeter-totter arm 66 is shown attached to a shaft 68. A crank arm 70 (FIGS. 8 and 9) is attached to the shaft 68 inwardly of a pillow block 72 which serves to mount the shaft 68 for rotation. Pillow block 72 is bolted or otherwise secured to a frame member 74. A connecting rod 76 is interconnected between an outer end of the crank arm 70 and the upper end of a piston rod 78. As shown by FIGS. 8 and 9, a clevis 80 at the upper end of the connecting rod 76 receives between its tines an outer end portion of the crank arm 70 and a pivot pin 82 extends through the tines and the outer end portion of the crank arm 70, to pivotally connect the upper end of the connecting rod 76 to the crank arm 70. In similar fashion, the upper end of the piston rod 78 includes a clevis 84 which receives between its tines the lower end portion of the connecting rod 76. A pivot pin 86 provides a pivot joint connection between the clevis 84 and the connecting rod 76. As should be evident, an extension of the piston rod 78 moves the connecting rod 76 upwardly and rotates the crank arm 70, shaft 68 and the teeter-totter lever 66. As shown by FIGS. 7, 10 and 11, a first push-pull rod 88 is interconnected between an end of lever 66 and an end portion 64 of the lower splicer head 28. A second push-pull rod 90 is interconnected between the second end of lever 66 and an end portion 62 of the upper splicer head 26. The connections are pivot pin connections. Accordingly, a teetering rotation of the lever 66 in the clockwise direction (as viewed in FIGS. 7, 8 and 10), causes rod 88 to move upwardly and rod 90 to move downwardly. Rod 88 pushes splicer head 28 upwardly and rod 90 pulls splicer head 26 down. A retraction of the cylinder rod 66 will cause a teetering rotation of the lever 54 in the opposite direction. This will cause rod 76 and splicer head 28 to move downwardly and rod 78 and splicer head 26 to move upwardly. It is in this manner that the splicer heads 26, 28 in the illustrated embodiment are moved together and apart. The cylinder 79, and the various levers and arms 66, 70, 76, 78, 88, 90 are duplicated at the second end of the machine 22 (FIG. 11).

The upper and lower splicer heads 26, 28 are substantially identical in construction. Thus, splicer head 26 is an upside down version of splicer head 28.

Figure 13:
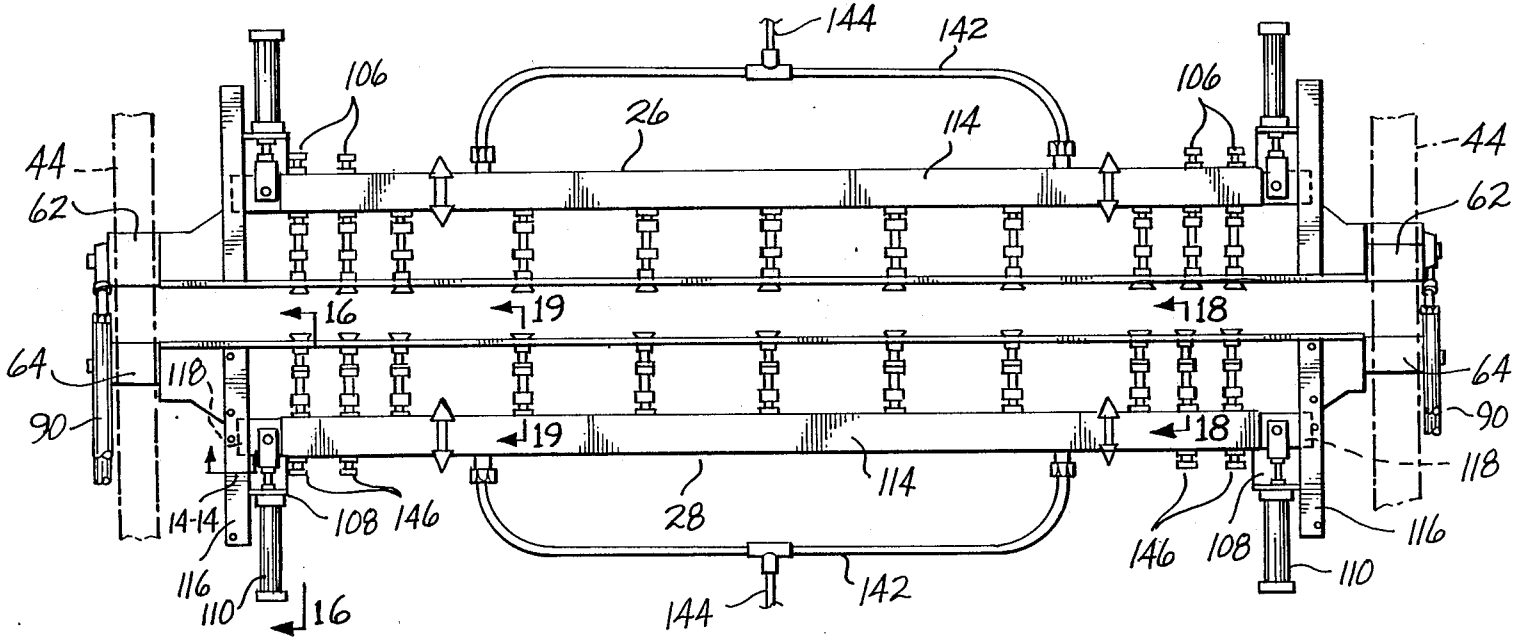
FIG. 13 is a side elevational view of the upper and lower splicer heads, shown in a separated position, and apart from the support structure, and showing a portion of the mechanism which moves them together and apart.

Both splicer heads 26, 28 are shown in FIG. 13. Only splicer head 28 will be described in detail, with reference to FIGS. 16–19. However, it is to be understood that the description applies as well to splicer head 26, except for the direction of orientation of its parts.

Referring to FIGS. 16–19, splicer head 28 comprises a frame 92 which includes an elongated plate member 94 which extends the full length of the frame 28. A steel angle 96 has a long leg 98 which is in contact with, and secured to, the plate member 92. Steel angle 96 includes a short leg 100 having an upper surface 102 which is a presser surface. A plurality of openings 104 are formed in the leg 100, one for each of a plurality of suction nozzles 106 which are a part of the splicer head 128. A pair of support brackets 108 are secured to the plate 94, one at each end of the frame 96. A pair of air cylinders 110 are secured to the support brackets 108. Each air cylinder 110 includes a piston 112 which projects outwardly from the cylinder 110, towards the presser member 100. The outer ends of the piston rods 112 are connected to the ends of an elongated tubular manifold 114. A pair of vertically extending slideways 116 are connected to the frame 96 outwardly of the air cylinders 110. The slideways 116 are channel shaped in cross section and receive the end portions 118 of the manifold 114. The cylinders are fixed in position relative to the frame 96 and the slideways 116. Extension and retraction of the piston rods 112 moves the manifold 114, and the suction nozzles 106 connected thereto, up and down. When the piston rods 112 are retracted (FIG. 16), elastomeric suction cups 120 at the free ends of the vacuum nozzles 106 are positioned closely adjacent the presser surface 102. When the vacuum is off, the cups 120 project upwardly a small distance beyond the presser surface 120. When the vacuum is on, it causes the cup 120 to retract somewhat, as will hereinafter be described in more detail.

The vacuum nozzles 106 that are illustrated are made up of small links of pipe and pipe fittings. The lower ends of the tubes 106 extend into the manifold 114. Manifold 114 is a tubular member that has been closed at its ends to form an elongated vacuum chamber.

Figure 15:
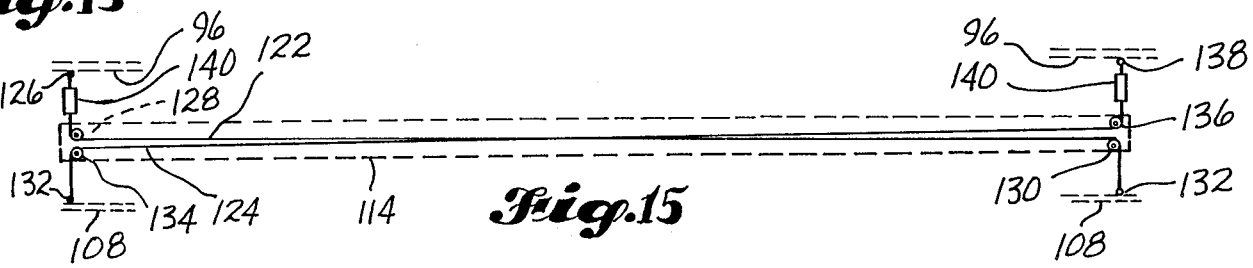
FIG. 15 is an elevational view of Jacobs parallel movement guide system which may be incorporated into each splicer head.
Figure 14:
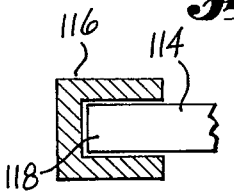
FIG. 14 is a sectional view taken substantially along line 14—14 of FIG. 13.
Figure 19:
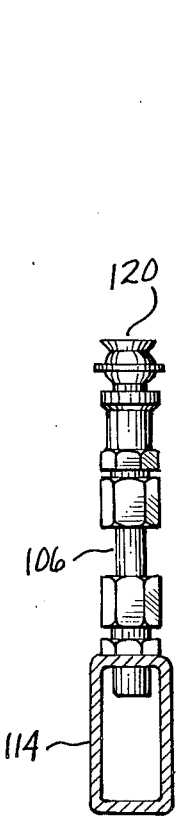
FIG. 19 is a view taken substantially along line 19—19 of FIG. 13.
Figure 18:
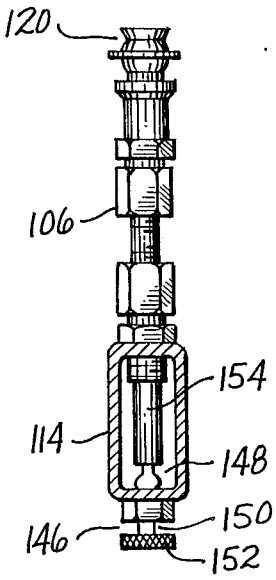
FIG. 18 is a sectional view taken substantially along line 18—18 of FIG. 13.
Figure 17:
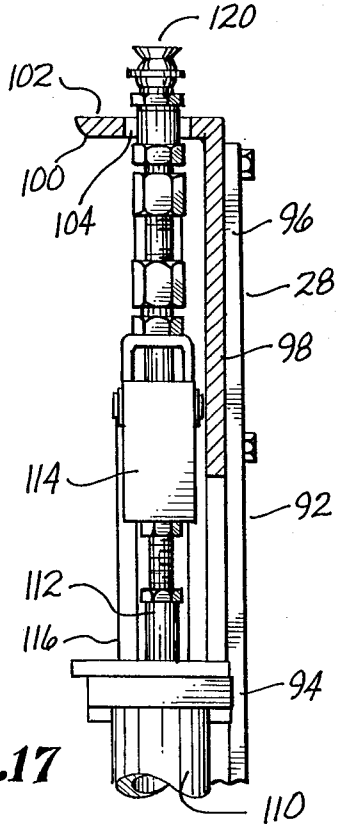
FIG. 17 is a view of the upper portion of FIG. 16, showing the vacuum pick-up units extended.
Figure 16:
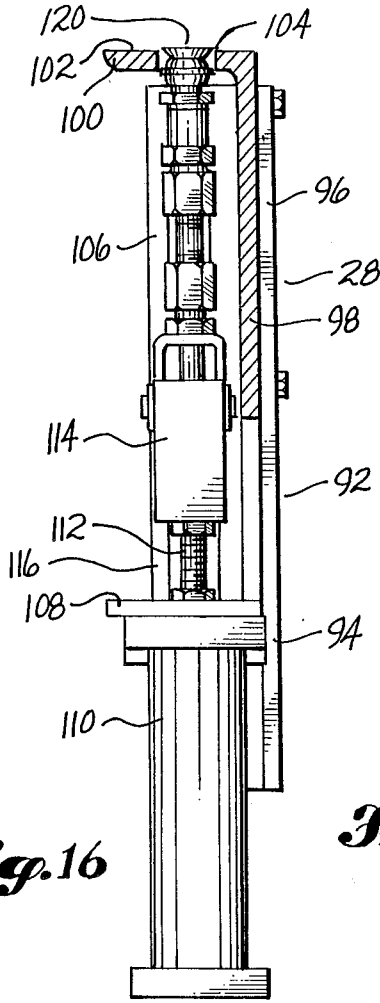
FIG. 16 is an enlarged scale sectional view taken substantially along line 16—16 of FIG. 13, showing the vacuum pick-up units substantially retracted.

An extension of the piston rods 112 will move the vacuum nozzles 106 upwardly through the openings 104 in the presser member 100 (FIG. 17). Referring to FIG. 15, the presser head 28 may include a Jacobs-type parallel movement guide system. As shown by FIG. 15, this system comprises a pair of guide wires 122, 124. Wire 122 is anchored at point 126 to an end portion of frame 96. It extends down to and around a roller 128 which is mounted for rotation on the near end of manifold 114. Wire 122 then extends longitudinally of manifold 114 to and around a second roller 130 which is mounted for rotation on the opposite end portion of the manifold 114. Wire 122 then extends downwardly from roller 130 to a connection point 132 which is on the air cylinder mounting flange 108. The rollers 128, 130 are mounted on the side of manifold 114 that is the back side in FIG. 15.

The guide wire 124 is connected to mounting flange 108 at the left end of the assembly (as viewed in FIG. 15). It extends up to and then over the roller 134. Next, it extends longitudinally of the manifold 114 to a roller 136. From roller 136 it extends upwardly to an anchor point 138 on frame 96. The rollers 134, 132 are located on the foreground side of manifold 114. Each guide line 122, 124 includes a turnbuckle 140, provided for adjusting the tension in the lines 122, 124. When the turnbuckles 140 are properly adjusted, the manifold 114 extends parallel to the presser surface 102. The system of guide lines 122, 124 and wheels 128, 130, 134, 136 maintains the manifold 114 parallel to the presser surface 102 as the manifold 114, and the vacuum nozzles 106 connected to it, are moved up and down by the air cylinders 110.

Figure 21:
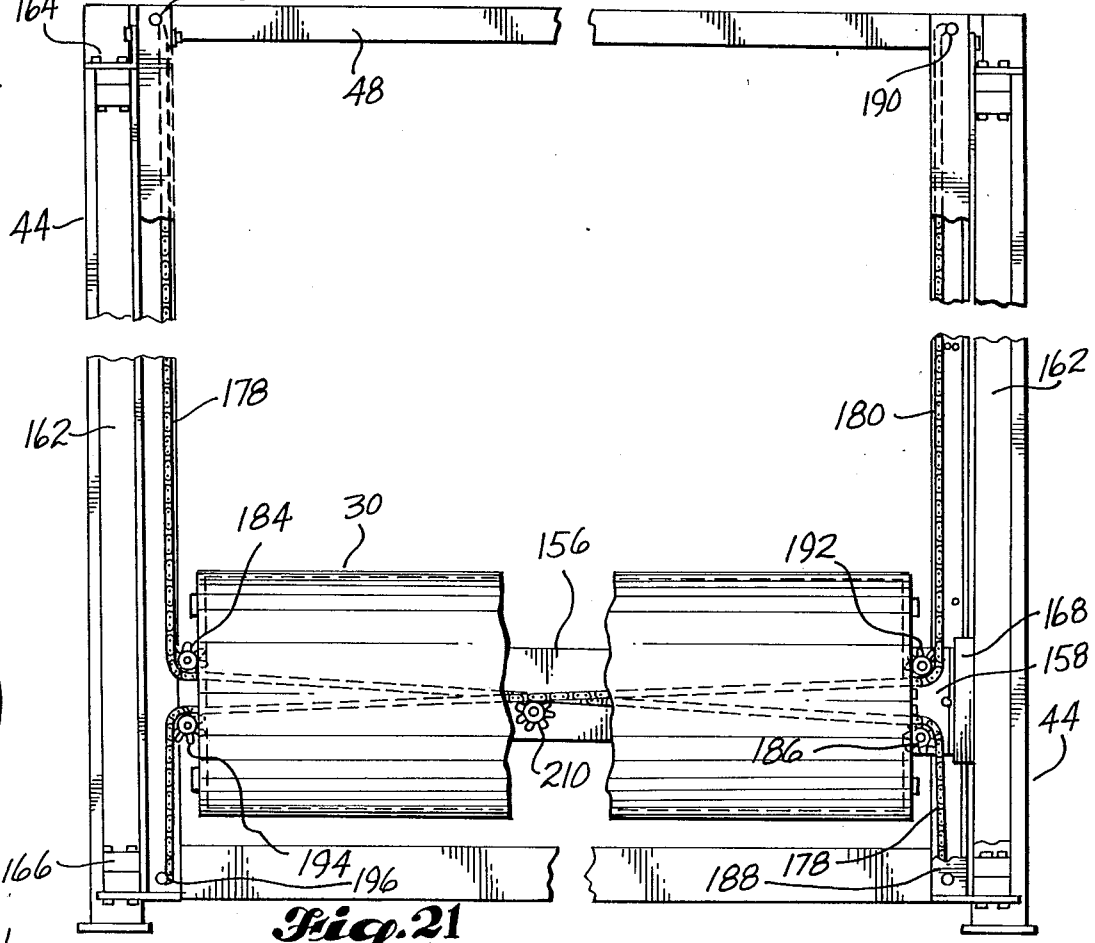
FIG. 21 is an elevational view taken substantially along line 21—21 of FIG. 20, such view being broken away at its middle in both the vertical and horizontal directions, for the purpose of reducing the height and width dimensions of the view, with a foreground portion of the loop forming roll cut away to show a portion of the guide which extends through a central support for the loop forming roll, and with the central portion of a foreground frame member being cut away for the purpose of illustrating the connection of one end of a central support member for the loop forming roll to the piston of an air cylinder, and a portion of the guide chain.
Figure 20:
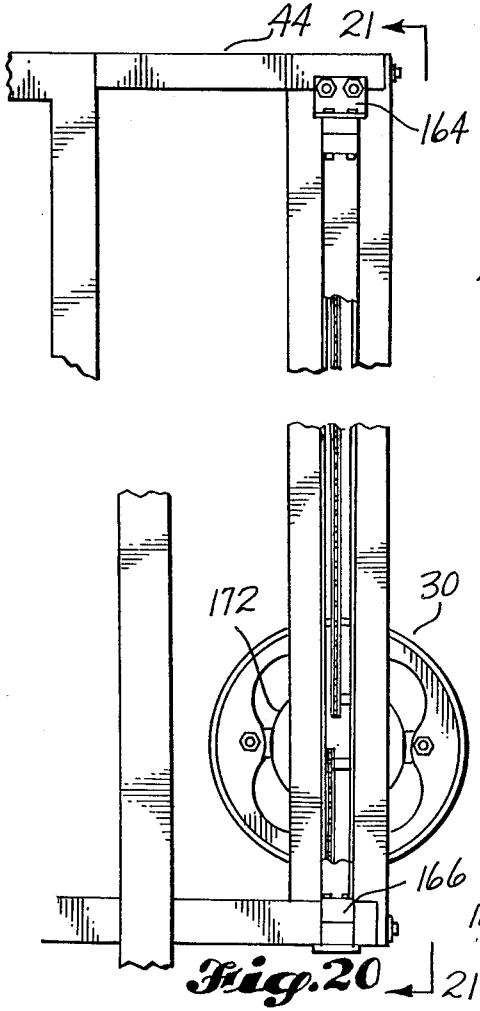
FIG. 20 is a fragmentary end elevational view looking towards one end of the frame, in the vicinity of the loop forming roll, such view being broken away at its center so that the vertical height of the view can be reduced, with a central portion of an air cylinder being cut away for the purpose of illustrating a chain portion of a Jacobs guide.

Conduits 142, 144 connect the manifold 114 with a vacuum pump. The mounted end portions of the vacuum tubes 106 open into the interior of the manifold 114. In preferred form, the outermost two vacuum tubes 106, at each end of the manifold 114, include off/on valves 146. These may simply comprise a valve plug 148 (FIG. 18) at the inner end of a rotatable valve stem 150 which includes a control knob 152 at its outer end. Rotation of the knob 152 and valve stem 150 in a first direction moves the valve plug 148 into a position closing the inlet opening of an inner end portion 154 of the vacuum tube 106. Rotation in the opposite direction opens this inlet. The machine 22 is adjustable to handle different width webs of sheet material. When a web is being handled that is of a width positioning its side edges inwardly of the outermost vacuum nozzle 106 at each end of the manifold 114, the valves 146 on such outermost vacuum nozzles 106 are closed. If a still narrower web is being handled, which has side edges located inwardly of the next pair of vacuum nozzles 106, the valves 146 on those vacuum nozzles 106 are also closed. Referring to FIGS. 20–26, the loop forming roll 30 is shown to be mounted on, and for rotation about, an elongated center support 156. Center support 156 has end portions 158 which extend endwise beyond the ends of the loop forming roll 30. These end portions 158 fit into vertically elongated guideways 160 (FIG. 7). A rodless air cylinder 162 is positioned immediately outwardly of each guideway 160. Each air cylinder 162 extends vertically and at its upper and lower ends 164, 166 is secured to the end frame 44 at its end of the machine 22. As best shown by FIG. 21, the piston portion 168 of each air cylinder 162 has a side part which extends laterally inwardly from the air cylinder 162 and is connected to the adjacent end portion 158 of the center support 156.

Figure 25:
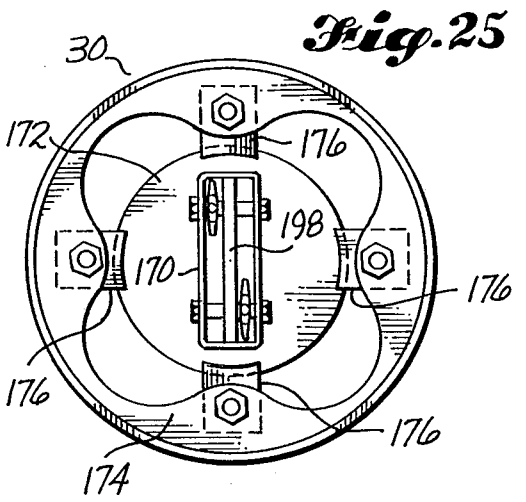
FIG. 25 is a sectional view taken substantially along line 25—25 of FIG. 22.
Figure 26:
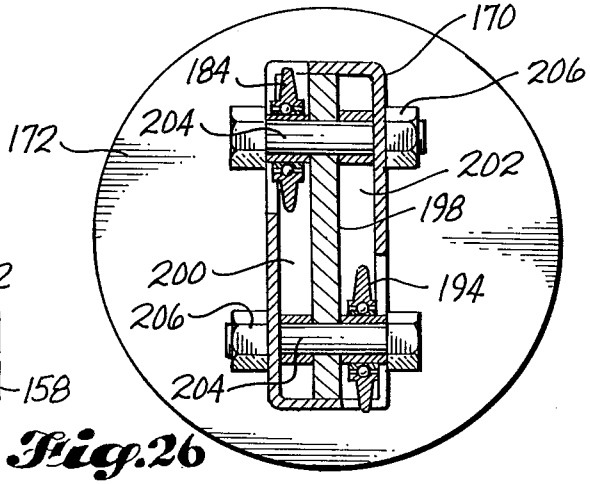
FIG. 26 is a sectional view taken substantially along line 26—26 of FIG. 24, omitting the guide chain.

Referring to FIGS. 22–26, the center support 156 preferably has a tubular body 170 having a rectangular cross sectional shape (FIG. 26). A pair of circular disks 172 are secured to the body 170, one at each end of the body 170. The disks 172 are spaced axially inwardly from the ends of the body 170. The outer end portions 158 project axially outwardly from the disks 172.

Figure 22:
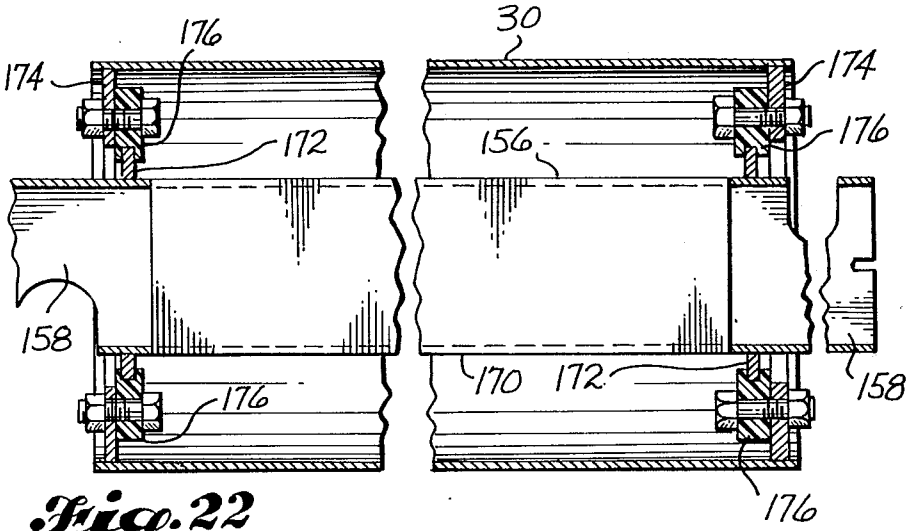
FIG. 22 is a longitudinal sectional view of the loop forming roll, broken away at its middle and at its ends, to enable the view to be shortened, and omitting the center roll, the sprockets and the guide chain form the support member which extends through the center of the loop roll.
Figure 23:
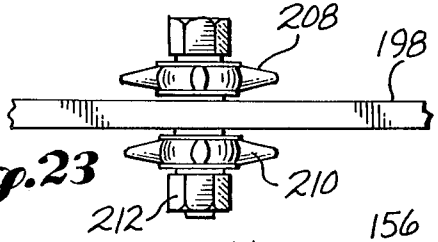
FIG. 23 is a fragmentary top plan view of a center portion of a vertical wall within the support member for the loop forming roll, and two sprockets carried by it, minus the guide chain.
Figure 24:
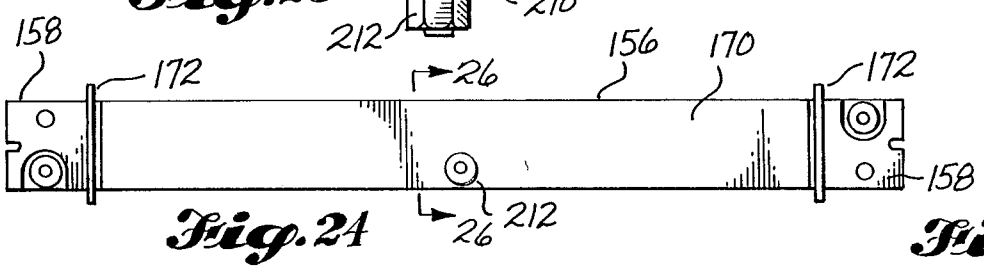
FIG. 24 is a reduced scale side elevational view of the support member for the loop forming roll.

As best shown by FIGS. 22 and 25, the loop forming roll 30 has end walls 174 which carry a plurality of bearings 176. The bearings 176 may be bolted to the end wall 174. Each includes a radially inwardly projecting portion which engages the periphery of the disk 172 at its end of the support 156. The bearings 156 may be slide bearings, constructed from a self-lubricated plastic material, as illustrated, or they may be roller elements which make rolling contact with the periphery of the disks 172. Regardless of the construction of the bearing elements 176, the bearing elements 176 serve to mount the loop forming roll 30 for free rotation about the cylinder support 156.

In preferred form the loop forming roll assembly includes a Jacobs-style parallel movement mechanism for insuring that the axis of the loop forming roll 30 stays level as the loop forming roll 30 is moved up and down. This mechanism is shown in FIG. 21 to include first and second guide chains 178, 180. Guide chain 178 is connected at its upper end 182 to an upper portion of the end frame 44 at one end of the machine 22. Chain 178 extends downwardly from the upper end connection to and then around a roller 184 that is mounted on the adjacent end portion 158 of the center support 156. Chain 78 extends from roller 184 through the center body 170 to and then around a second roller 186 that is mounted on the end portion 158 of center support 156, on the opposite side of the machine. From roller 186 the chain 178 extends downwardly to a lower end connection 188 with the machine frame. In similar fashion, the guide chain 180 is connected at its upper end to a location 190 on the machine frame. It extends downwardly from such end connection 190 to and then around a roller 192 that is mounted for rotation on the end portion 158. Chain 180 then extends from roller 192 through the center tube 170 to and then around another roller 194 that is mounted on the end portion 158 at the first end of the center support 156. Guide chain 180 then extends downwardly to a point of connection 196 with the machine framed. One end of each guide chain 178, 180 is adjustably mounted for the purpose of adjusting the amount of tension in the guide chains 178, 180, and positioning the center support 156 so that the axis of rotation of the loop forming roll 30 is level. As best shown by FIG. 26, the center space in body 170 is divided into two side compartments by a sidewall 198. Guide chain 178 extends through a first side compartment 200. Guide chain 180 extends through the second side compartment 202. The rollers 184, 186, 192, 194 may be mounted for rotation about bolt type axles 204 which extend laterally through the end portions 158 and are each secured in place by a nut 206. Preferably, a pair of guide sprockets 208, 210 are mounted on center wall 198. Sprocket 208 is located within chamber 200 and engages a lower portion of the guide chain 178. Sprocket 210 is located in chamber 202 and engages a lower portion of the guide chain 180. A nut and bolt assembly 212 may be used to secure the sprockets 208, 210 in place and provide a fixed axle (the bolt shank) about which they can rotate.

The Jacobs parallel movement mechanism, and the manner which it operates, are per se well known. Thus, it is only necessary to state that when air is introduced into the cylinders 162, in the chambers below the pistons 168, and at the same time exhausted from the chambers above the pistons 168, the pistons 168 will be forced upwardly, carrying the center support 156 and the loop forming roll 30 with them. The parallel movement mechanism 178, 180, etc., will maintain the axis of rotation of loop forming roll 30 in a level position as it moves upwardly. It will perform the same function when the air pressure is shifted to the upper chambers, and the lower chambers are exhausted, for the purpose of moving the loop forming roll 30 downwardly.

Figures 27, 28:
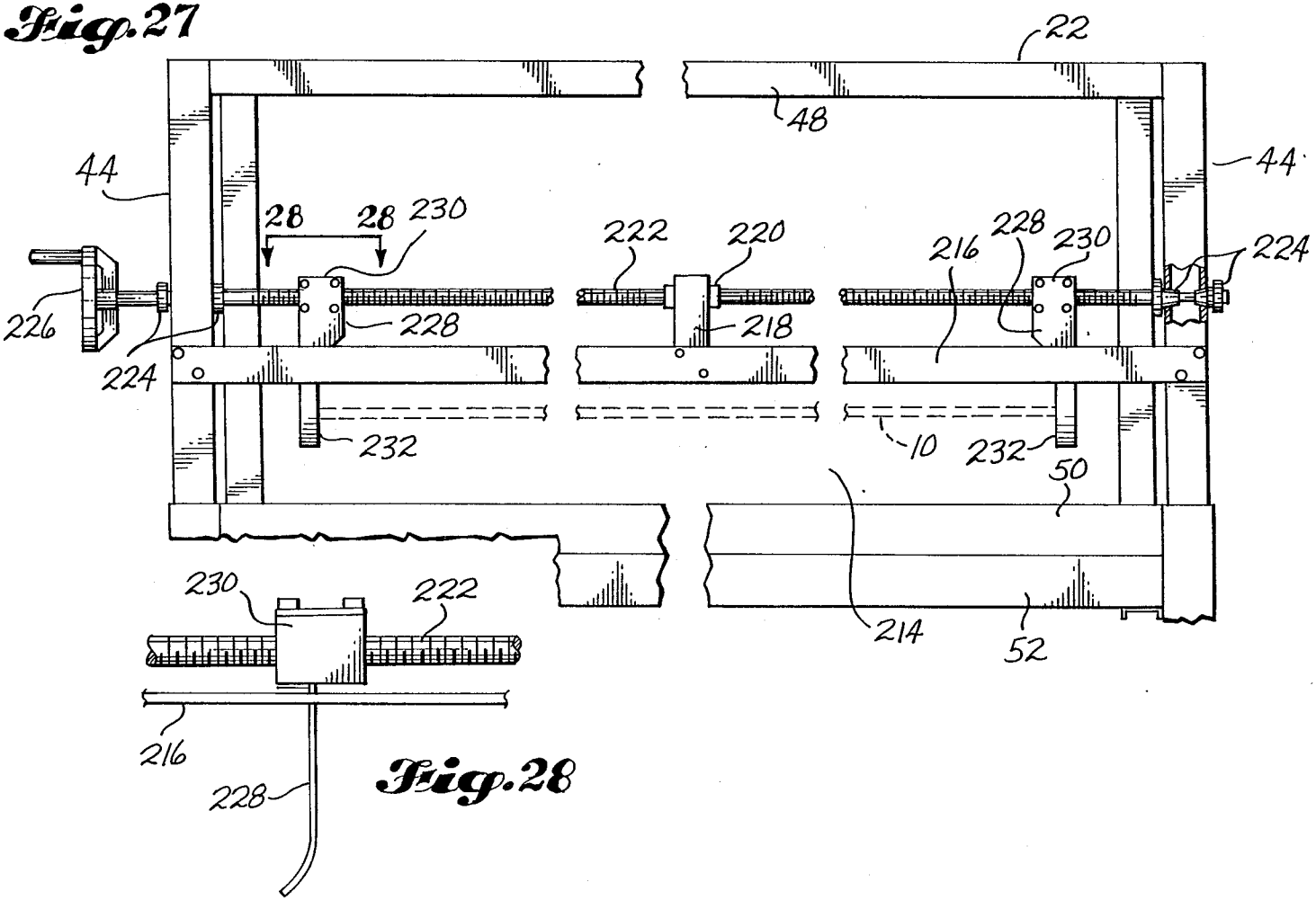
FIG. 27 is a fragmentary elevational view looking into the infeed side of the joint forming machine, showing an adjustable side guide mechanism for the sheet material, with other portions of the machine omitted.
FIG. 28 is a fragmentary top plan view taken substantially along line 28—28 of FIG. 27.

FIG. 27 is a view looking towards the entrance side of the machine 22. The web of sheet material (10 or 20) travels through a space 214, located vertically between horizontal frame members 216, 50. Frame member 216 is a bar that is connected at its end to the two end frames 44. A support post 218 is connected to and extends upwardly from the center of bar 216. It carries a bearing 220 which receives a nonthreaded central portion of a threaded shaft 222. The ends of the shaft 222 include nonthreaded portions which are mounted for rotation by bearings 224. A handle 226 is provided at one end of the shaft 22. A pair of side guides 228 are mounted on, and for movement along, the shaft 222. An upper end portion 230 of each side guide 228 includes threads which mate with the threads on the rod 222. Rotation of the handle 226 and the rod 222 in one direction, causes the side guides 228 to move towards each other, narrowing the width of the horizontal space between sidewalls 232 which are located within the space 214. Rotation of the handle 226 and the rod 222 in the opposite direction causes the sidewalls 232 to move apart, to widen the space between them.

Referring to FIGS. 29–33, the machine 22 includes a pair of sheet cutters 234, 236. The cutters 234, 236 are identical in construction. Each comprises a rodless air cylinder 238 and a knife unit 240 that is connected to an exterior part of the piston portion 242 of the air cylinder 238. As best shown by FIGS. 32 and 33, the knife unit 240 may comprise a body 244 constructed from a length of metal iron. The horizontal leg 246 of member 244 is formed to include fastener openings 248' which receive screws 250 (FIG. 29) used for securing the frame 244 to the outboard portion of the piston 242. The vertical leg 252 of frame member 244 serves to mount a cutter blade 254. Cutter blade 254 includes an adjustment slot 256 and a cutting edge 258. A clamping screw 260 extends through an opening (not shown) in a clamp plate 262, then through the slot 256, and then through an opening in vertical leg 252 of member 244. The screw 260 is tightened for the purpose of clamping the blade 254 in position between members 262 and 252.

As shown in FIGS. 29 and 32, the cutting edge 258 extends at a diagonal. As a result, it makes a progressive entry into the sheet material 10 or 20, as the knife unit 240 is moved by the air cylinder 238 laterally across the web 10 or 20. As shown by FIG. 29, the use of a rodless air cylinder makes it possible to move the knife unit from a start position against one of the end frames 44 over to a finish adjacent the opposite end frame 44. Both the start and finish positions of the knife unit 240 are located outwardly of a side edge of the web 10 or 34.

As shown by FIG. 30, the knife blade 254 of cutter 236 is directed upwardly. The knife blade 254 of cutter 234 is directed downwardly, at a location that is forward of the lower knife blade 254, in the feed direction. The lower knife 236 cuts the web 10 from the first storage roll 16. The upper cutter 234 cuts the web 240 from the second storage roll 20. The horizontal distance between the planes of the two knifes 254 determines the amount of overlap of the webs 10, 34 at the joint.

Referring to FIGS. 34 and 35, a retractable hold-down finger assembly is positioned in the machine 22 above the lead end portion of the support roll 24. This assembly includes a pair of vertical guideways 264, 266, mounted on the inner sides of vertical frame members 268, 270. These are the downstream members of the pairs of frame members which define the guide slots 56. Each guideway 264, 266 receives and guides for movement a vertical side arm portion 272, 274 of a support frame 276 for a plurality of hold-down fingers 278. The hold-down fingers 278 are secured to and depend from a horizontal member 280 which at its ends is connected to the lower ends of the members 272, 274. The hold-down fingers 278 have sloping lower end portions 282. The upper ends of members 272, 274 are connected to the piston portions of air cylinders 284. FIG. 34 shows the cylinders 284 retracted and the hold-down finger assembly 276 n a raised position. The cylinders 284 are extended for the purpose of moving the assembly downwardly to place the end portions 282 of the fingers 278 in a gap forming relationship with the lead end portion of the hold-down cylinder 24. A gap is formed which is only slightly thicker than the sheet material. No pressure is applied on the sheet material. Thus, the sheet material can move through the gap that is formed.

Perferably, the upper end portions of the hold-down fingers 278 are threaded and extend through vertically aligned openings in the upper and lower walls of the member 280. A first nut 286 is threaded on the threaded portion of hold-down members 278 below the member 80. A second nut 288 is threaded on such portion above the member 280. The positions of the nuts 286, 288 on the members 278 can be used to adjust the position of the lower ends 282 of members 278, relative to the hold-down roll 24.

Figure 36:
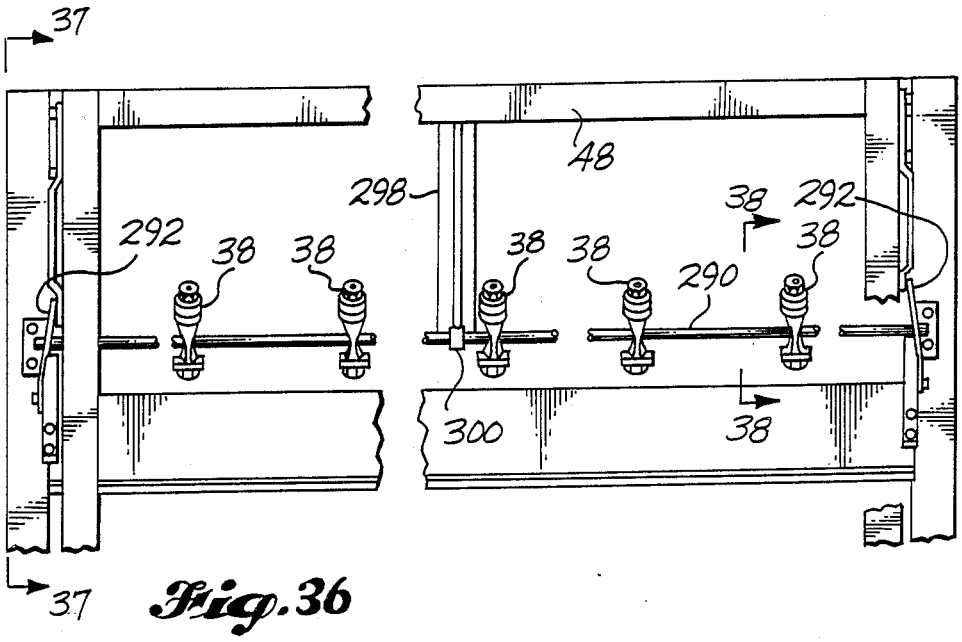
FIG. 36 is an elevational view of a spray bar assembly for adhesive, broken away at places for the purpose of reducing the size of the view.
Figure 37:
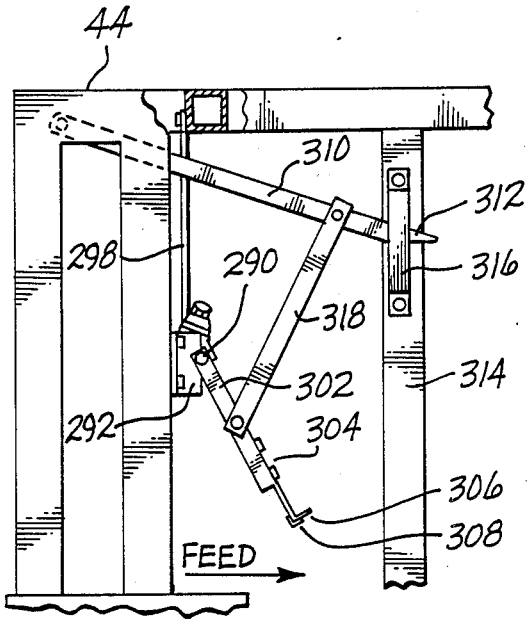
FIG. 37 is an end view of the spray bar assembly, taken substantially along line 37—37 of FIG. 36.
Figure 38:
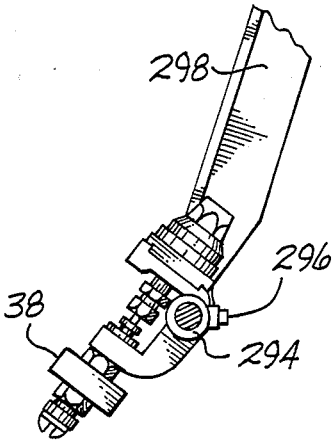
FIG. 38 is an enlarged scale side elevational view of a single spray nozzle, taken substantially along line 38—38 of FIG. 36.

FIGS. 36–42 show a stop gate assembly and mechanism for spraying an adhesive on one of the webs of sheet material. FIG. 42 shows that both of these mechanisms are positioned generally above the guide roll 24. Referring first to FIGS. 36–38, a support rod 290 for the spray nozzles 38 is shown to at its ends extend through mounting brackets 292 which are secured to the end frames 44. Each spray nozzle 38 includes a tubular sleeve 294 through which the support rod 290 extends, and a set screw 296 extending through a wall of the sleeve 294, and usable for securing the nozzle 38 in position on the support rod 290. The support rod 290 is supported near its middle by an arm 298 which is secured at its upper end to the horizontal frame member 48. The rod 90 extends through an opening formed in a lower end portion 300 of the arm 298.

As shown best by FIGS. 37 and 42, the rod 290 extends through upper portions of end members 302 for a stop gate 304. The rod 290 serves as a fixed axle about which the members 302 pivot. The stop gate 304 includes an angle member 306 at its lower portion. This member includes two legs and a corner where the two legs intersect. Preferably, this corner is covered by a thin metal member which includes a large number of openings. The openings give the member 38 the ability to grip the sheet material without making holes in the sheet material.

Figure 4:
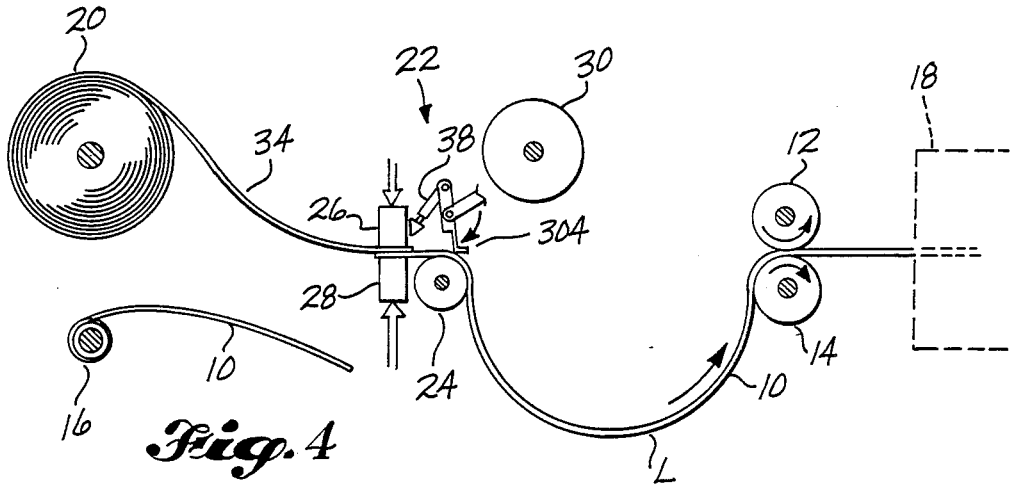
FIG. 4 is a view like FIGS. 1-3, showing two splicer heads being moved together to press together a forward end portion of sheet material from the second storage roll and a rear end portion of the sheet material being fed out from the loop, to exert a connecting pressure on said overlapping portions, and showing sheet material being fed out from said loop.

In preferred form, a lever 310 is pivotally attached at its upper end to the machine frame. Its lower end 312 is located within a space defined between frame member 314 and a thin strap of metal 316 that at its ends is connected to the frame member 314. A positioning link 318 is pivotally connected at its upper end to an intermediate portion of lever 310 and at its lower end to an intermediate portion of member 302. As should be evident, a lifting of lever 310 will cause the stop gate 304 to be swung upwardly. A lowering of the lever 310 will swing the stop gate 304 downwardly. As shown by FIGS. 3 and 4, when the stop gate 304 is in its down position, the perforated corner cover 308 is in contact with the support roll 24, on the outfeed side of the roll. When the stop gate 34 is down, it holds the web 10, 34 against the support roll 34 and also holds support roll 24 against rotation.

Figure 39:
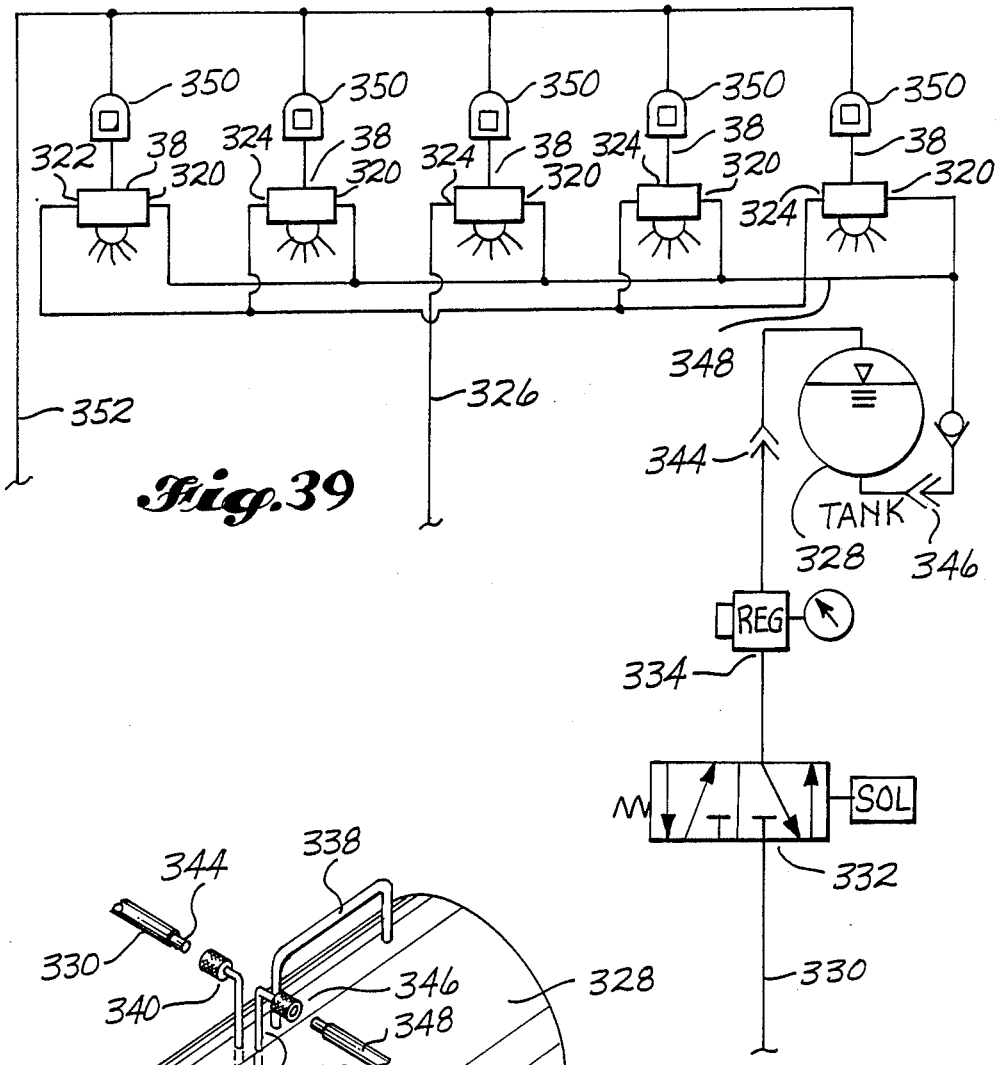
FIG. 39 is a schematic diagram of the adhesive system.

Referring to FIG. 39, the spray nozzles 38 are atomizer type nozzles, very similar to the nozzles used in a paint sprayer. Each includes an inlet 320 for the adhesive, and an inlet 324 for atomizing air. The air is clean air delivered from a conduit 326. The adhesive comes from a storage tank 328. Clean air from a source 330 is introduced into the tank 328, for pressure feeding the adhesive out from the tank 328. A solenoid controlled off/on valve 332 is located within air line 330. A pressure regulating valve 334 is also located within the conduit 330. Pressure regulator 334 maintains the feed pressure in the tank at a predetermined level, e.g. 18 psi.

Figure 40:
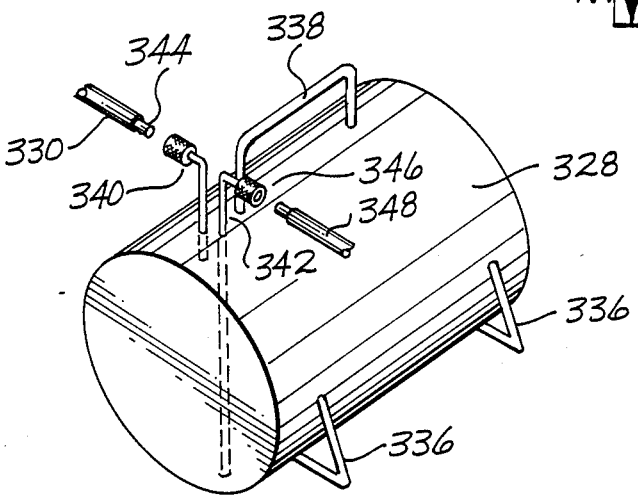
FIG. 40 is a pictorial view of the adhesive tank.

As shown by FIG. 40, the adhesive tank 238 is preferably a portable unit. It includes support legs 336 at its bottom and a handle 338 at its top. It includes a feed air inlet 340 and an adhesive outlet 342. A quick connect-disconnect type coupling 344 is provided between the feed air conduit 330 and the feed air inlet 340. In similar fashion, a quick connect-disconnect coupling 346 is provided between the adhesive outlet 342 and a delivery conduit 348 which extends to the adhesive inlets 320 for the spray nozzles 38. When the tank 238 is nearly empty the conduits 330 and 348 are disconnected from the tank 238 and the tank is picked up and carried to a source of the adhesive, for refilling.

Each spray nozzle 38 includes a built-in off/on valve that is very similar to the off/on valve in a paint sprayer, except that it is operated by air pressure rather than by a finger control mechanism. The operating mechanisms for the off/on valves are designated 350 in FIG. 39. Lubricated air is delivered via a conduit 352 to the valve operators 350. The valves are closed when the air pressure is off. When air pressure is introduced into conduit 352 and delivered to the operators 350 it opens the valves and allows the air to atomize the adhesive and deliver it via the spray nozzles 38 to the sheet material. Valve 332 is open and feed air is delivered to the tank 328 only when it is time to deliver adhesive to the sheet material.

In operation, a web 10 of sheet material from the first storage roll 16 is guided through the machine 22 to the feed rolls 12, 14. The side guides 232 (FIG. 27) are spaced apart a distance only slightly larger than the width dimension of the sheet 10.

The feed rolls 12, 14 feed the web 10 from the storage roll 16 until the storage roll 16 is almost empty. Then, while feeding of web 10 is continuing, the air cylinders 162 are operated to move the feed roll 30 downwardly, to form the loop L. Then, air is delivered to the cylinders 284 for the purpose of moving the hold-down finger assembly 276 downwardly. As earlier explained, the lower end portions 282 of the hold-down fingers 278 form gaps between themselves and the leading portion of the support roll 64 which is slightly larger than the thickness dimension of the web 10. The hold-down fingers 278 prevent the web 10 from rising and/or slipping back upon retraction of the loop forming roll 30.

Next, the leading end portion of the web 34 from storage roll 20 is hand fed into the space between the two splicer heads 26, 28. The vacuum nozzles 106 for upper splicer heads 26 are extended and the upper manifold 114 is connected to a vacuum. The suction cups 126 on the upper vacuum nozzles 106 grab the web 34 and pull it against the presser surface 102 of splicer head 106. The suction cups collapse so that the web 34 is against upper pressure surface 102.

Next, the air cylinder 238 of cutter 234 is operated to cause the upper knife blade 254 to move laterally across and cut the web 34. The cutter blade 254 of the upper cutter 238 cuts the web 34 while the web 34 is held against the upper presser surface 102 by the upper vacuum nozzles 106. This cutting provides a square cut leading end 36 on web 34.

Next, the loop forming roll 30 is retracted and the stop gate 304 is moved downwardly against the web 10, to clamp it against the support roll 24 and stop movement of the web 10 rearwardly of the loop L. Then, the vacuum nozzles 106 of the lower splicer head 28 are extended and put into operation to grab the web 10 and pull it tight against the presser surface 102 of the head 28. Then, the air cylinder 238 of cutter 236 is operated to cause the lower knife blade 254 to move laterally across and cut the web 10.

Then, while the splicer heads 26, 28 are still separated, and the end portions of the webs 10, 34 are still held by suction against the upper and lower presser heads 102, the adhesive system is actuated. Valve 332 is opened and feed air is delivered into the tank 328. At the same time, air is delivered via conduit 352 to the operators 350 for the off/on valves. And, atomizing air is delivered via conduit 326 to the atomizing inlets 322. The adhesive is pressure fed, atomized and sprayed onto the upper surface of the trailing portion of web 10. The adhesive is in the nature of a solvent which partially melts the foam material and makes a paste out of its surface. While the surface is still in this condition, and after adhesive-delivery has been ceased, the cylinders 79 are operated to cause lever 66 to rock and connecting rods 88, 90 to move the splicer heads 26, 28 together. The lower surface of the leading portion of web 34 is moved into contact with the upper surface of the trailing end portion of web 10 and the two surfaces are pressed tightly together. Within a short amount of time the melted plastic dries and solidifies and when this happens the overlapping end portions of the webs 10, 34 are firmly connected together. The cylinders 79 are reversed to move the splicer heads 26, 28 apart. Also, the stop gate 304 is retracted. Shortly thereafter the loop L is removed from the web 10, by operation of the feed rolls 12, 14, and continuing operation of the feed rolls 12, 14 causes the web 10 and the joint 40 to pull the web 34 into the feed rolls 12, 14 and into production.

Figure 43:
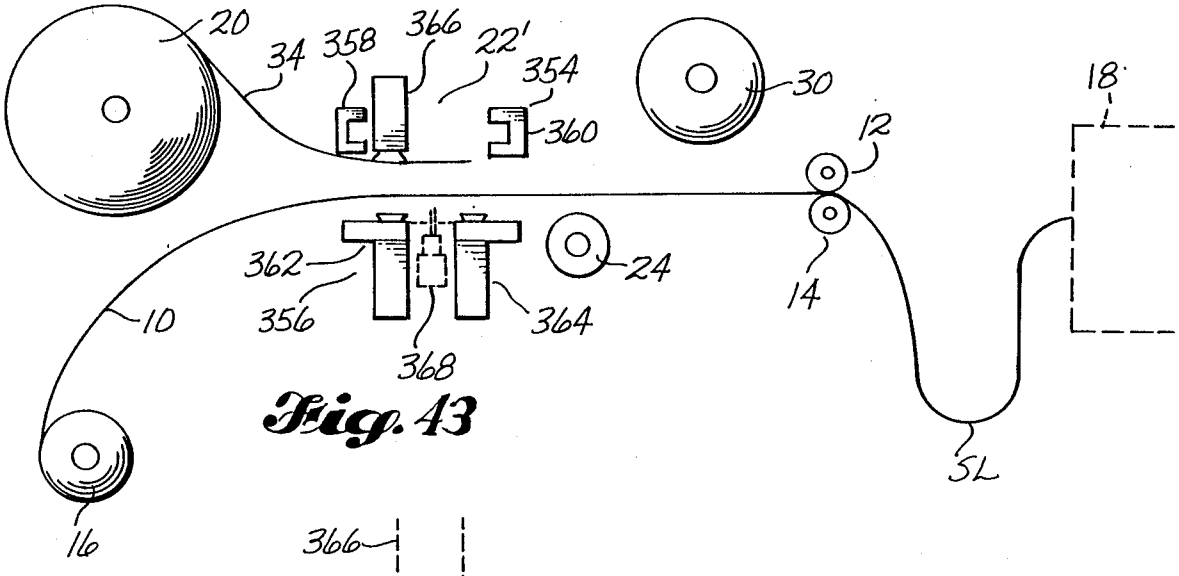
FIG. 43 is a schematic view similar to FIG. 1, showing apparatus for making a taped butt connection.
Figure 44:
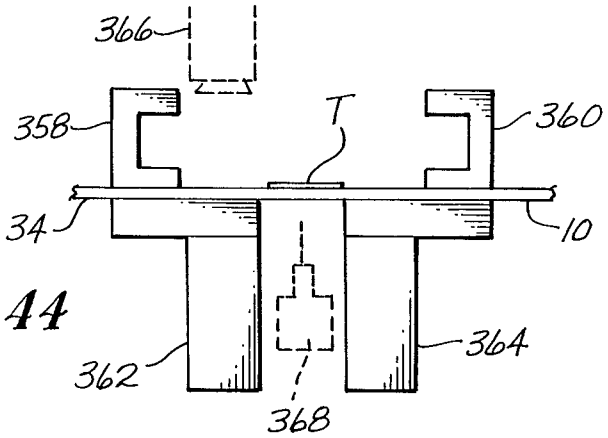
FIG. 44 is an enlarged scale view of the splicing equipment shown in FIG. 43, holding the webs while tape is being applied.

The lap tight joint, secured by the use of an adhesive, made in the manner and with the equipment that has been described above, is the preferred way of connecting the trailing end portion of sheet material from an almost empty roll to the forward end portion of sheet material from a new roll. However, the basic invention is not dependent on any particular way of connecting the two webs together. By way of example, the two webs may be placed in an overlapping position, held in that position, and then both cut together, to form abutting ends where the cut is made. Then, a piece of transverse tape can be applied over the cut, to connect the two ends together. In this regard, FIGS. 43 and 44 show the formation of a taped butt joint. In this embodiment, the splicing machine 22 comprises an upper splicer head 354 and a lower splicer head 356. Upper splicer head 354 may include a pair of horizontally spaced apart tracks or channels 358, 360 which extend across the web 10, from one side of the machine 22' to the other. The lower splicer head 356 comprises a pair of horizontally spaced apart assemblies 362, 364 which are mounted to travel together and which in construction may be similar to the splicer heads 26, 28, described above. A vacuum pick up assembly 366 is located above the web 10, between the members 358, 360. Members 358, 360 are movable up and down together. Vacuum pick up assembly 366 is movable up and down by itself.

Referring to FIG. 43, the web 10 is fed by the feed rolls 12, 14 off from the first storage roll 16, through the splicing machine 22', onto a utilization device. The slag loop SL may exist between the feed rolls 12, 14 and the utilization station 18, enabling the utilization station 18 to operate on a start and stop basis while the feed rolls 12, 14 operate on a continuous basis. Shortly before the first storage roll 16 expires, the leading end portion of the web 34 from the new storage roll 20 is manually introduced between the splicer heads 354, 356 and is held there by operation of the vacuum assembly 366. Then, the loop roll 30 is moved downwardly to provide a loop L. As in the first embodiment, this allows the feed rolls 12, 14 to continue in operation while the connection is being made. As soon as the loop forming roll 30 reaches its lower position, it is immediately returned to its upper position. Next, the suction nozzles of the lower head parts 362, 364 are activated to grab a hold of the web 10 and pull it into contact with the upper presser surfaces of the parts 362, 364. Then, upper vacuum assembly 366 is lowered to bring the upper web 34 down into contact with the lower web 10. A cutter 368 is operated to move across the webs 10, 34. It carries a knife which cuts both webs 10, 34 at the same time. The cutter 368 may be identical to cutters 234, 238. Its start position is outwardly of a first edge of the webs 10, 34. Its finish position is outwardly of the opposite edges of the webs 10, 34. Lower head 36 then releases the tail of web 10 which either by itself falls out of the way or is manually moved out of the way. Then, head 356 is again energized so that it will grab a hold of the web 34. After this happens the upper section head 366 is deactivated so that it will release its hold on the web 34. Head 366 does not release the web 34 until after web 34 has been grabbed by the head 356. This assures that no relative movement of either web 10, 34 after the cut is completed. After head 366 has been deactivated, to release the web 34, it is retracted up out of the way. Then, the upper head parts 358, 360 and the lower head parts 362, 364 are moved relatively together, to clamp between them the webs 10, 34 (FIG. 44). Next, a strip of tape T is applied lengthwise of the cut so that half of it overlaps a rear end portion of web 10 and the other half overlaps forward end portion of web 34. The members 358, 360 may function as a guide track for a tape applying device which is in principle similar to the tape applying devices which are used for taping boxes. Such device is storage roll for the tape and a roller which exerts pressure on the back side of the tape as the device is moved lengthwise of the cut. Or, a strip of tape may be supported on an elongated member which is inserted across the webs 10, 34, over the cut, and then lowered to move the tape T against the end portions of the webs 10, 34.

It will be apparent to those skilled in the art that various changes may be made in the details and arrangement of the equipment that has been illustrated and described above, without departing from the spirit and scope of the invention. The invention is not to be limited by the illustrated example, but rather by the claims interpreted in accordance with established principles of patent claim interpretation, including use of the doctrine of equivalents.

What is claimed is:

1. In combination:

a storage station for sheet material, including a first storage roll of sheet material and a second storage roll of sheet material;

feed means spaced horizontally from the storage station, said feed means serving to receive sheet material from a storage roll and feed it one to a utilization station; and a splicing machine located in series between the storage station and the feed means, comprising:

a frame;

a web support means on said frame, over which a first web of sheet material travels as it moves from the first storage roll to the feed means;

a loop forming roll positioned in series between the web support means and the feed means, for forming a loop in said first web of sheet material, said loop forming roll including a center support having end portions and a roller mounted for rotation about the center support;

said frame including a first pair of vertical guideways, one on each side of the machine, for engaging and guiding the end portions of the center support of the loop forming roll, for supporting the loop forming roll for movement vertically between an inactive upper position above the level of the web support means and a loop forming lower position substantially below the level of the web support means;

splicing means of said frame adjacent the web support means, for connecting a leading end portion of a second web of sheet material from the second storage roll to the first web of sheet material while said first web of sheet material is being fed by the feed means out from the loop, on to the utilization station, said splicing means comprising upper and lower splicer heads, each having a presser surface directed towards the presser surface of the other, and between the first web of sheet material moves as it is being fed by the feed means from the first storage roll to the utilization station, and also between which a leading end portion of the second web of sheet material can be placed when it is desired to connect the second web to the first web, said upper and lower splicer heads each including end portions;

said frame comprising a second pair of vertical guideways, one on each side of the machine, for engaging and guiding the end portions of the upper and lower splicer heads; and means engaging the end portions of the upper and lower splicer heads, for moving the upper and lower splicer heads together and apart.

2. The combination of claim 1, wherein the means for moving the upper and lower splicer head together and apart comprises a rocker member positioned on the frame on a side of the machine, means mounting the rocker member for rotation about an axis which is spaced vertically from and is parallel with the upper and lower splicer heads, a first drive arm interconnected between an end portion of the upper splicer head on the same side of the machine as the rocker member, and a portion of the rocker member spaced radially outwardly from the axis, and a second drive arm interconnected between an end portion of the lower splicer head, on the same side of the machine as the rocker member, and a portion of the rocker member spaced radially outwardly from the axis in a direction opposite from the first drive arm, whereby rotation of the rocker member in one direction will move the drive arms to pull the upper splicer head downwardly and push the lower splicer head upwardly, and rotation of the rocker member in the opposite direction will move the drive arms to push the upper splicer head upwardly and pull the lower splicer head downwardly.

3. The combination of claim 2, further comprising vacuum pick-up means associated with each splicer head, with the vacuum pick-up means associated with the upper splicer head being operable to grip the leading end portion of the second web of sheet material and hold it against the presser surface of the upper splicer head, and with the vacuum pick-up means associated with the lower splicer head being operable to grip the first web of sheet material and hold it against the presser surface of the lower splicer head.

4. The combination of claim 3, wherein each vacuum pick-up means comprises a plurality of suction tubes which are extendible and retractable as a group, between a retracted position within their splicer head and an extended position out from their splicer head.

5. The combination of claim 1, wherein the web support means is a web support roll having an axis extending transverse to the direction of material movement, and said web support roll is positioned to be contacted by each web of sheet material as it is being fed by the feed means to the utilization station.

6. The combination of claim 5, further comprising stop means supported above the web support roll, and movable between an inactive position elevated above the web support roll and a lowered position in which it contacts the first web of sheet material and presses it against the web support roll, and means for moving the stop means against the first web of sheet material where it is supported on the web support roll following movement of the loop forming roll to form the loop, to hold the first web of sheet material in position against the web support roll while the second web of sheet material is being connected to the first web of sheet material.

7. The combination of clam 1, further comprising power means for moving the loop forming roll vertically, comprising a pair of vertically elongated, rodless, double-acting air cylinders, one at each end of the center support for the loop forming roll, each said air cylinder including a traveling piston having a connector portion projecting laterally of the air cylinder, and means connecting said connector portion to the adjacent end portion of the center support for the loop forming roll.

8. The combination of claim 7, wherein the splicing machine further includes means for moving the two ends of the loop forming roll evenly.

9. The combination of claim 8, wherein the center of support for the loop forming roll is tubular, and the means for moving the two ends of the loop forming roll evenly comprises a first guide line having first and second ends, said first end being anchored to an upper location on the frame, at one end of the loop forming roll, said guide line extending vertically downwardly from said first end to a first end of the center support for the loop forming roll, and then extending through said center support, and at the second end of the center support extending downwardly to a lower anchor point on the frame, and a second guide line having first and second ends, said first end of the second guide line being anchored at an upper location on the frame above the second end of the center support, and extending downwardly to the second end of the center support, and then through the center support, and at the first end of the center support extending downwardly to a lower anchor point on the frame.

10. The combination of claim 9, wherein the first and second guide line means are lengths of roller chain, and said center support for the loop forming roll includes two sprocket gears at each of its ends, one for each roller chain, said chains engaging the sprocket gears when they enter and leave the center support for the loop forming roll.

11. The combination of claim 1, further comprising cutting means for cutting the first web of sheet material from the first storage roll, to form a cut rear end on said first web of sheet material, said cutting means comprising a knife mounted to travel transversely across the first web of sheet material and power means for moving the knife.

12. The combination of claim 11, further comprising hold down means for exerting a downward pressure on the first web of sheet material in the vicinity of where it is cut by the cutting means, so that movement of the first web in response to any curl energy in the first web of sheet material that is released by the cutting of the first web of sheet material will be resisted by the hold down means.

13. The combination of claim 11, wherein the power means for moving the knife comprises a rodless, double acting air cylinder extending transversely of the web of sheet material, and including a traveling piston with a carrier portion projecting laterally of the cylinder, said knife being mounted on said carrier portion, and said rodless cylinder being mounted on said frame.

14. The combination of claim 1, further comprising cutting means for cutting the second web of sheet material from the second storage roll, to form a cut forward end on said second web of sheet material, said cutting means comprising a knife mounted to travel transversely across the second web of sheet material and power means for moving the knife.

15. The combination of claim 14, wherein the power means for moving the knife comprises a rodless, double acting air cylinder extending transversely of the web of sheet material, and including a traveling piston with a carrier portion projecting laterally of the cylinder, said rodless cylinder being mounted on said frame.

16. The combination of claim 1, wherein said upper and lower splicer heads include vacuum grip means, and said vacuum grip means on the upper slicer head grabs a hold of a leading portion of the web of sheet material from the second storage roll and holes it in an elevated position when the upper and lower splicer heads are apart, and the vacuum gripper means on the lower splicer head grabs hold of the web of sheet material from the first storage roll and holds it in a lowered position when the upper and lower splicer heads are apart, and said splicing machine further includes means for cutting across the web of sheet material from the second roll when such web is held by the vacuum means in an elevated position, to form a leading end of the web of sheet material from the second storage roll which is positioned to overlap the web of sheet material from the first storage roll, and said splicing machine also including means for delivering an adhesive to at least one of the webs of sheet material while they are gripped by the vacuum means of the upper and lower splicer heads and are held apart, and said means for moving the upper and lower splicer heads together and apart being operable to exert a squeezing pressure on the leading end portion of the second web of sheet material and the portion of the first web of sheet material below it, to cause the adhesive to bond the webs together.

17. The combination of claim 1, wherein said splicing means comprises means including the upper and lower splicer heads for positioning a leading end of sheet material from the second storage roll into a substantially abutting relationship to a rear end of sheet material from the first storage roll, so that a strip of tape can be applied to both the leading end of the web of sheet material from the second storage roll and the rear end of the web of sheet material from the first storage roll, to in that manner connect such ends together.

18. For use with a traveling web of sheet material being fed from a storage roll to a utilization device, a mechanism for forming a loop in the web of sheet material as it is traveling, comprising:

a loop forming roll including a center support having end portions and a roller mounted for rotation about the center support;

a frame including a pair of vertical guideways, one on each side of the path of travel of the web of sheet material, for engaging and guiding the end portions of the center support of the loop forming roll, and for supporting the loop forming roll for movement vertically between an inactive upper position above the level of the path of travel of the web of sheet material and a loop forming lower position substantially below the level of the path of travel of the web of sheet material; and power means for moving the loop forming roll vertically from its upper position to its lower position, to form a loop in the traveling web, and then back to its upper position, comprising a pair of vertically elongated, rodless, double-acting air cylinders, one on each end of the support means, each said air cylinder including a traveling piston having a connector portion projecting laterally of the air cylinder, and means connecting said connector portion of the adjacent end portion of the center support for the loop forming roll.

19. The combination of claim 18, further including means for moving the two ends of the loop forming roll evenly during the vertical movement of the loop forming roll.

20. The combination of claim 19, wherein the center support for the loop forming roll is tubular, and the means for moving the two ends of the loop forming roll evenly comprises a first guide line having first and second ends, said first end being anchored to an upper location on the frame, at one end of the loop forming roll, said guide line extending vertically downwardly from said first end to a first end of the center support for the loop forming roll, and then extending through said center support, and at the second end of the center support extending downwardly to a lower anchor point on the frame, and a second guide line having first and second ends, said first end of the second guide line being anchored at an upper location on the frame above the second end of the center support, and extending downwardly to the second end of the center support, and then through the center support, and at the first end of the center support extending downwardly to a lower anchor point on the frame.

21. The combination of claim 20, wherein the first and second guide line means are lengths of roller chain, and said center support for the loop forming roll includes two sprocket gears at each of its ends, one for each roller chain, said chains engaging the sprocket gears when they enter and leave the center support for the loop forming roll.

22. A machine for connecting the leading end of sheet material from a full storage roll to a rear portion of sheet material from an almost empty storage roll, while continuing to feed the sheet material, comprising:

means for forming a loop in the sheet material from the almost empty roll while feeding such sheet material; and means rearwardly of the loop for stopping the sheet material from the first roll at a location rearwardly of the loop, and connecting it to a leading end of sheet material from a full roll, while the sheet material from the first roll is being fed from said loop, said loop forming means comprising a roll having an axis which extends transversely to the sheet material, and which is free to rotate about its axis, and means for supporting and vertically moving such roll between an inactive upper position above the feed path of the sheet material and a lower loop forming position, including an elongated center support extending axially through the loop forming roll and having opposite end portions, a frame including guide means for guiding the end portions of the support as the loop forming roll moves between it upper and lower positions, and power means connected to said end portions, for moving the support up and down, wherein the center support for the loop forming roll is tubular, and said machine further including guide means for guiding the center support for the loop forming roll as it is moved vertically, and moving the two ends of the loop forming roll evenly, said guide means comprising a first guide line having first and second ends, said first end being anchored at an upper location on the frame, at one end of the loop forming roll, said guide line extending vertically downwardly from said first end to a first end of the center support for the loop forming roll, and then extending through said center support, and at the second end of the center support extending downwardly to a lower anchor point on the frame, and a second guide line having first and second ends, said first end of said second guide line being anchored at an upper location on the frame above the second end of the center support, and extending downwardly to the second end of the center support, and then through the center support, and at the first end of the center support extending downwardly to a lower anchor point on the frame.

23. The machine of claim 22, wherein the first and second guide line means are lengths of roller chain, and said center support for the loop forming roll includes two sprocket gears at each of its ends, one for each roller chain, said chains engaging the sprocket gears where they enter and leave the center support for the loop forming roll.

24. The machine of claim 23, wherein the power means comprises a pair of vertically elongated, rodless, double acting air cylinders, one at each end of the support means, each said air cylinder including a traveling piston having a connector portion projecting laterally of the air cylinder, and means connecting said connector portion to the adjacent end portion of the center support for the loop forming roll.

25. The machine of claim 22, wherein the power means comprises a pair of vertically elongated, rodless, double acting air cylinders, one at each end of the support means, each said air cylinder including a traveling piston having a connector portion projecting laterally of the air cylinder, and means connecting said connector portion to the adjacent end portion of the center support for the loop forming roll.

26. In combination:

a storage station for sheet material, including a first storage roll of sheet material and a second storage roll of sheet material;

feed rolls spaced horizontally from the storage rolls, said feed rolls serving to receive sheet material from a storage roll and feed it onto a utilization station; and a splicing machine located between the storage station and the feed rolls, comprising:

a support means over which a first web of sheet material travels as it moves from the first storage roll to the feed rolls;

a loop forming roll positioned horizontally between the support means and the feed rolls, and movable vertically between an inactive upper position above the level of the support means and a loop forming lower position substantially below the level of the support means;

means for moving the loop forming roll downwardly from its upper position to its lower position, to form a free loop in the first web of sheet material, and then back upwardly to its upper position, while the first web of sheet material is being fed by the feed rolls out from the free loop to the utilization station; and means adjacent the support means for connecting a leading end portion of a second web of sheet material from the second storage roll to the first web of sheet material while said first web of sheet material is being fed by the feed rolls out from the loop and onto the utilization station, including an upper splicer head, a lower splicer head, and means for moving the splicer heads together and apart, each splicer head having a presser surface directed toward the presser surface of the other, and between which the first web of sheet material moves as it is being fed by the feed rolls from the first storage roll to the utilization station, and also between which a leading end portion of the second web of sheet material can be placed when it is desired to connect the first web to the second web, and means for applying an adhesive to a surface of one of the webs of sheet material which is directed towards the other web, while the two splicer heads are apart, said means for moving the upper and lower splicer heads together and apart being operable to insert a squeezing pressure on the leading end portion of the second web of sheet material and the portion of the first web of sheet material below it, to cause to the adhesive to bond the webs together, and vacuum pick-up means associated with each splicer head, with said vacuum pick-up means associated with the upper splicer head being operable to grip the leading end portion of the second web of sheet material and hold it against the presser surface of the upper splicer head, and with the vacuum pick-up means associated with the lower splicer head being operable to grip the first web of sheet material and hold it against the presser surface of the lower splicer head, and wherein each vacuum pick-up means comprises a plurality of suction tubes which are extendible and retractable as a group, between a retracted position within their splicer head and an extended position out from their splicer head in which said suction tubes are positioned to grip ahold of their web of sheet material.

27. The combination of claim 26, wherein the support means is a support roll having an axis that is parallel to the axis of rotation of the feed rolls, and each web of sheet material being fed by the feed rolls from a storage roll passes over and is in contact with the support roll.

28. The combination of claim 26, further comprising stop means supported above the support means, and movable between an inactive position elevated above the support means and a lowered position in which it contacts the first web of sheet material and presses it against the support means, said stop means being usable to hold the first web of sheet material in position against the support means following movement of the loop forming roll to form the loop and while the second web is being connected to the first web.

29. The combination of claim 26, further comprising cutting means for cutting the first web of sheet material from the first storage roll, to form a cut rear end on said first web of sheet material, said cutting means comprising a knife mounted to travel transversely across the first web of sheet material and power means for moving the knife.

30. The combination of claim 29, further comprising second cutting means for cutting the second web of sheet material, to form a cut forward end on said second web of sheet material, said second cutting means comprising a second knife mounted to travel transversely across the second web of sheet material and power means for moving the second knife.

31. The combination of claim 29, further comprising hold down means for exerting a downward pressure on the first web of sheet material in the vicinity of where it is cut by the cutting means, so that movement of the first web in response to any curl energy in the first web of sheet material that is released by the cutting of the first web of sheet material will be resisted by the hold down means.

32. In combination:

a storage station for sheet material, including a first storage roll of sheet material and a second storage roll of sheet material;

feed rolls spaced horizontally from the storage rolls, said feed rolls serving to receive sheet material from a storage roll and feed it onto a utilization station; and a splicing machine located between the storage station and the feed rolls, comprising:

a support means over which a first web of sheet material travels as it moves from the first storage roll to the feed rolls;

a loop forming roll positioned horizontally between the support means and the feed rolls, and movable vertically between an inactive upper position above the level of the support means and a loop forming lower position substantially below the level of the support means;

means for moving the loop forming roll downwardly from its first position to its second position, to form a loop in the first web of sheet material, and then back upwardly to its upper position, away from the loop, while the first web of sheet material is being fed from the loop by the feed rolls to the utilization station;

means adjacent the support means for connecting a leading end portion of a second web of sheet material from the second storage roll to the first web of sheet material while said first web of sheet material is being fed by the feed rolls out from the loop to the utilization station;

cutting means for cutting the first web of sheet material from the first storage roll, to form a cut rear end on said first web of sheet material, said cutting means comprising a knife mounted to travel transversely across the first web of sheet material and power means for moving the knife; and hold down means for exerting a downward pressure on the first web of sheet material in the vicinity of where it is cut by the cutting means, so that movement of the first web in response to any curl energy in the first web of sheet material, that is released by the cutting of the first web of sheet material, will be resisted by the hold down means.

33. The machine of claim 32, wherein said cutting means comprising a rodless, double acting air cylinder extending transversely of the web, and including a traveling piston with a carrier portion projecting laterally of the cylinder, and said knife is mounted on said carrier portion, said knife being positioned to cut the web of sheet material as the piston moves in the cylinder relatively across the web of sheet material.

34. The combination of claim 32, further comprising second cutting means for cutting the second web of sheet material, to form a cut forward end on said second web of sheet material, said second cutting means comprising a second knife mounted to travel transversely across the second web of sheet material and power means for moving the second knife.

35. The machine of claim 34 wherein said second cutting means comprises a rodless, double acting air cylinder extending transversely of the web, and including a traveling piston with a carrier portion projecting laterally of the cylinder, and said second knife is mounted on said carrier portion, said second knife being positioned to cut the second web of sheet material as the piston moves in the cylinder relatively across the second web of sheet material.

* * * * *

UNITED STATES PATENT AND TRADEMARK OFFICE

CERTIFICATE OF CORRECTION

PATENT NO. : 4,842,681

DATED : June 27, 1989

INVENTOR(S) : B. Robert Bader and Bernard W. Bader

It is certified that error appears in the above-identified patent and that said Letters Patent is hereby corrected as shown below:

Col. 3, line 38, "enlarge" should be -- enlarged --.

Col. 6, line 40, "spliting" should be -- splicing --.

Col. 9, line 47, "Referring" should begin a new paragraph.

Col. 11, line 37, "openings 248' " should be -- openings 248 --.

Col. 12, line 16, "n" should be -- in --.

Col. 15, line 40, "head 36" should be -- head 356 --.

Claim 1, col. 16, line 14, "one" should be -- on --.

Claim 1, col. 16, line 46, after "between", insert -- which --.

Claim 7, col. 17, line 48, "clam" should be -- claim --.

Claim 15, col. 18, line 52, after "said", insert -- knife being mounted on said carrier portion, and said --.

Claim 16, col. 18, line 58, "holes" should be -- holds --.

Claim 18, col. 19, line 49, "of", first occurrence, should be -- to --.

UNITED STATES PATENT AND TRADEMARK OFFICE

CERTIFICATE OF CORRECTION

PATENT NO. : 4,842,681

DATED : June 27, 1989

INVENTOR(S) : B. Robert Bader and Bernard W. Bader

It is certified that error appears in the above-identified patent and that said Letters Patent is hereby corrected as shown below:

Claim 26, col. 21, line 67, delete "to", second occurrence.

Signed and Sealed this

Twelfth Day of June, 1990

*Attest:*

HARRY F. MANBECK, JR.

*Attesting Officer*

*Commissioner of Patents and Trademarks*